US012084837B2

(12) United States Patent
Sumino et al.

(10) Patent No.: US 12,084,837 B2
(45) Date of Patent: Sep. 10, 2024

(54) HYDRAULIC SYSTEM OF EXCAVATOR, EXCAVATOR, AND METHOD FOR CONTROLLING EXCAVATOR

(71) Applicant: Komatsu Ltd., Tokyo (JP)

(72) Inventors: Wataru Sumino, Tokyo (JP); Shinobu Nagura, Tokyo (JP); Yuichi Hishinuma, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 18/275,092

(22) PCT Filed: Feb. 28, 2022

(86) PCT No.: PCT/JP2022/008181
§ 371 (c)(1),
(2) Date: Jul. 31, 2023

(87) PCT Pub. No.: WO2022/209510
PCT Pub. Date: Oct. 6, 2022

(65) Prior Publication Data

US 2024/0093467 A1 Mar. 21, 2024

(30) Foreign Application Priority Data

Mar. 30, 2021 (JP) ..... 2021-058214

(51) Int. Cl.
*E02F 9/22* (2006.01)
*E02F 3/43* (2006.01)

(52) U.S. Cl.
CPC ..... *E02F 9/2242* (2013.01); *E02F 3/435* (2013.01)

(58) Field of Classification Search
CPC ..... E02F 3/43; E02F 9/2242; F15B 2211/2656; F15B 2211/20576; F15B 2211/6653; F15B 2211/6313
See application file for complete search history.

(56) References Cited

U.S. PATENT DOCUMENTS

2016/0376770 A1 12/2016 Matsuzaki et al.
2019/0338494 A1* 11/2019 Moriki ..... E02F 9/2029
(Continued)

FOREIGN PATENT DOCUMENTS

JP 2001-248186 A 9/2001
JP 2015-172400 A 10/2015
(Continued)

*Primary Examiner* — Kenneth Bomberg
*Assistant Examiner* — Daniel S Collins
(74) *Attorney, Agent, or Firm* — Locke Lord LLP

(57) ABSTRACT

A hydraulic system of an excavator includes a work state determination unit and a valve control unit. When it is determined that a work state of working equipment is a heavy excavation state, the valve control unit controls a first boom operation valve, a first arm operation valve, a first bucket operation valve, a second boom operation valve, a second arm operation valve, and a second bucket operation valve such that passing of hydraulic oil from a first hydraulic pump to a boom cylinder is restricted, hydraulic oil is supplied from a second hydraulic pump to a boom cylinder, hydraulic oil is supplied from both the first hydraulic pump and the second hydraulic pump to an arm cylinder, and hydraulic oil is supplied from one or both of the first hydraulic pump and the second hydraulic pump to a bucket cylinder.

9 Claims, 10 Drawing Sheets

(56) References Cited

U.S. PATENT DOCUMENTS

| | | | |
|---|---|---|---|
| 2020/0011030 | A1 | 1/2020 | Nakano et al. |
| 2020/0325649 | A1 | 10/2020 | Tsukamoto et al. |

FOREIGN PATENT DOCUMENTS

| | | | |
|---|---|---|---|
| JP | 2019-039208 | A | 3/2019 |
| JP | 2019-052465 | A | 4/2019 |
| WO | 2017/168822 | A1 | 10/2017 |
| WO | 2019/131979 | A1 | 7/2019 |

* cited by examiner

HYDRAULIC SYSTEM OF EXCAVATOR, EXCAVATOR, AND METHOD FOR CONTROLLING EXCAVATOR

FIELD

The present disclosure relates to a hydraulic system of an excavator, an excavator, and a method for controlling an excavator.

BACKGROUND

In the technical field related to an excavator, an excavator as disclosed in Patent Literature 1 is known.

CITATION LIST

Patent Literature

Patent Literature 1: JP 2019-052465 A

SUMMARY

Technical Problem

The excavator includes three hydraulic cylinders of a boom cylinder, an arm cylinder, and a bucket cylinder. In a hydraulic system that distributes hydraulic oil discharged from two hydraulic pumps to three hydraulic cylinders, there is a possibility that hydraulic oil is not properly distributed to the hydraulic cylinders depending on a working state of working equipment.

An object of the present disclosure is to properly distribute hydraulic oil discharged from two hydraulic pumps to three hydraulic cylinders.

Solution to Problem

According to an aspect of the present invention, a hydraulic system of an excavator, the hydraulic system comprises: a first hydraulic pump; a second hydraulic pump; a boom cylinder that moves a boom of working equipment; an arm cylinder that moves an arm of the working equipment; a bucket cylinder that moves a bucket of the working equipment; a first boom operation valve that controls passing of hydraulic oil from the first hydraulic pump to the boom cylinder; a first arm operation valve that controls passing of hydraulic oil from the first hydraulic pump to the arm cylinder; a first bucket operation valve that controls passing of hydraulic oil from the first hydraulic pump to the bucket cylinder; a second boom operation valve that controls passing of hydraulic oil from the second hydraulic pump to the boom cylinder; a second arm operation valve that controls passing of hydraulic oil from the second hydraulic pump to the arm cylinder; a second bucket operation valve that controls passing of hydraulic oil from the second hydraulic pump to the bucket cylinder; an arm check valve that prevents backflow of hydraulic oil from the arm cylinder to the second hydraulic pump via the second arm operation valve; a bucket check valve that prevents backflow of hydraulic oil from the bucket cylinder to the second hydraulic pump via the second bucket operation valve; an operation device operated to actuate at least one of the boom cylinder, the arm cylinder, and the bucket cylinder; a work state determination unit that determines a work state of the working equipment based on an operation state of the operation device, a boom bottom pressure indicating a pressure of a bottom chamber of the boom cylinder, an arm bottom pressure indicating a pressure of a bottom chamber of the arm cylinder, and a bucket bottom pressure indicating a pressure of a bottom chamber of the bucket cylinder; and a valve control unit that controls at least one of the first boom operation valve, the first arm operation valve, the first bucket operation valve, the second boom operation valve, the second arm operation valve, and the second bucket operation valve based on the work state of the working equipment determined by the work state determination unit, wherein the work state determination unit determines that the work state of the working equipment is a normal state when an arm excavation operation amount of the operation device is equal to or larger than a first threshold, or a bucket excavation operation amount of the operation device is equal to or larger than a second threshold, and the boom bottom pressure is higher than a higher value of the arm bottom pressure and the bucket bottom pressure, and determines that the work state of the working equipment is a heavy excavation state when a higher value of the arm bottom pressure and the bucket bottom pressure is higher than the boom bottom pressure, and when it is determined that the work state of the working equipment is the heavy excavation state, the valve control unit controls the first boom operation valve, the first arm operation valve, the first bucket operation valve, the second boom operation valve, the second arm operation valve, and the second bucket operation valve such that passing of hydraulic oil from the first hydraulic pump to the boom cylinder is restricted, hydraulic oil is supplied from the second hydraulic pump to the boom cylinder, hydraulic oil is supplied from both the first hydraulic pump and the second hydraulic pump to the arm cylinder, and hydraulic oil is supplied from one or both of the first hydraulic pump and the second hydraulic pump to the bucket cylinder.

Advantageous Effects of Invention

According to the present disclosure, hydraulic oil discharged from two hydraulic pumps is properly distributed to three hydraulic cylinders.

DESCRIPTION OF EMBODIMENTS

Hereinafter, embodiments according to the present disclosure will be described with reference to the drawings, but the present disclosure is not limited to the embodiments. The components of the embodiments described below can be appropriately combined. Some components are not used in some cases.

[Excavator]

Figure 1:
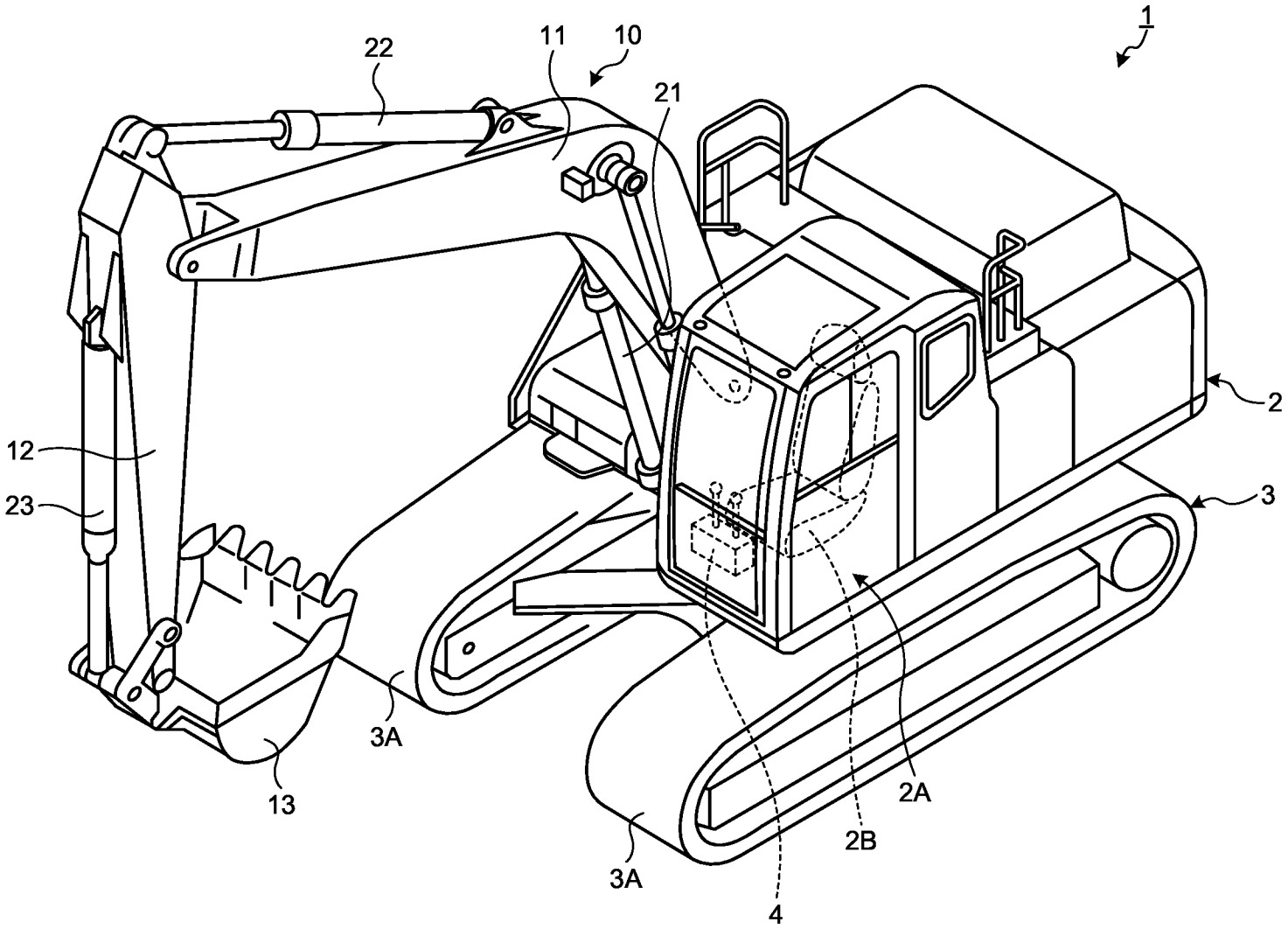
FIG. 1 is a perspective view illustrating an excavator according to an embodiment.

FIG. 1 is a perspective view illustrating an excavator 1 according to an embodiment. As illustrated in FIG. 1, the excavator 1 includes a swing body 2, a travel body 3, an operation device 4, working equipment 10, a boom cylinder 21, an arm cylinder 22, and a bucket cylinder 23.

The swing body 2 supports the working equipment 10. The swing body 2 includes an operation room 2A. An operator of the excavator 1 boards the operation room 2A. An operator's seat 2B on which the operator sits is provided in the operation room 2A.

The travel body 3 supports the swing body 2. The travel body 3 includes a pair of crawler belts 3A. The excavator 1 travels with the rotation of the crawler belts 3A. The travel body 3 may include a tire attached to an axle.

The operation device 4 is operated by the operator of the excavator 1. The operation device 4 is operated to move the working equipment 10. The operation device 4 is disposed in the operation room 2A.

The working equipment 10 includes a boom 11, an arm 12, and a bucket 13. The boom 11 is rotatably coupled to the swing body 2. The arm 12 is rotatably coupled to the boom 11. The bucket 13 is rotatably coupled to the arm 12.

Each of the boom cylinder 21, the arm cylinder 22, and the bucket cylinder 23 is a hydraulic cylinder. The boom cylinder 21 moves the boom 11. The arm cylinder 22 moves the arm 12. The bucket cylinder 23 moves the bucket 13.

[Motion of Working Equipment]

Figure 2:
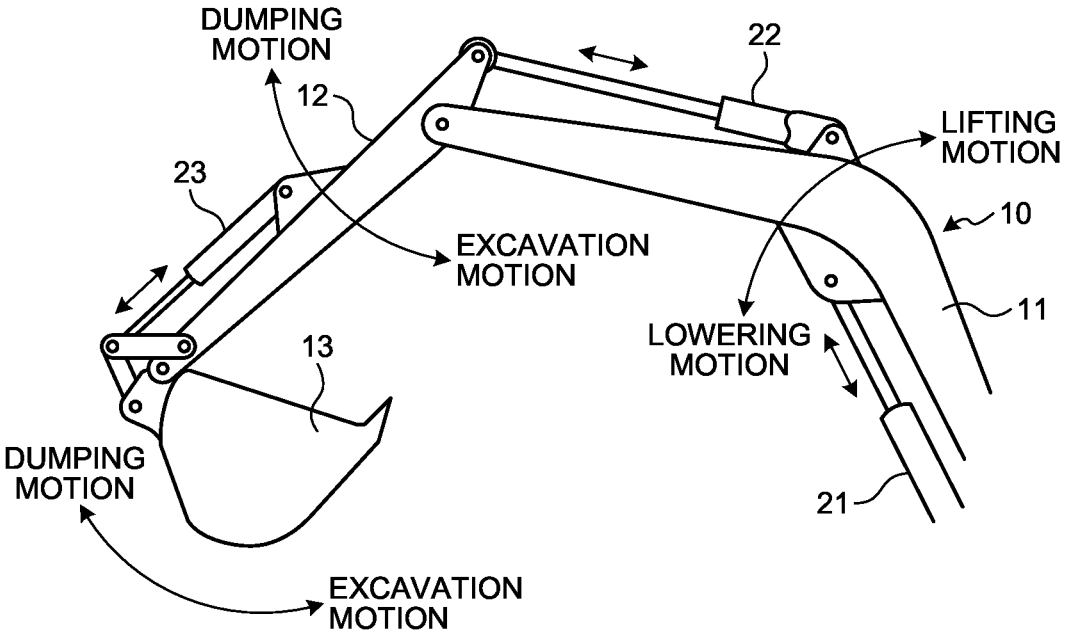
FIG. 2 is a schematic diagram for describing motions of working equipment according to the embodiment.

FIG. 2 is a schematic diagram for describing motions of the working equipment 10 according to the embodiment. At least one of the boom cylinder 21, the arm cylinder 22, and the bucket cylinder 23 is actuated by operating the operation device 4.

The boom cylinder 21 causes the boom 11 to perform a lifting motion or a lowering motion. Causing the operation device 4 to perform boom lifting operation causes the boom cylinder 21 to extend and the boom 11 to perform the lifting motion. Causing the operation device 4 to perform boom lowering operation causes the boom cylinder 21 to retract and the boom 11 to perform the lowering motion.

The arm cylinder 22 causes the arm 12 to perform an excavation motion or a dumping motion. Causing the operation device 4 to perform arm excavation operation causes the arm cylinder 22 to extend and the arm 12 to perform the excavation motion. Causing the operation device 4 to perform arm dumping operation causes the arm cylinder 22 to retract and the arm 12 to perform the dumping motion.

The bucket cylinder 23 causes the bucket 13 to perform an excavation motion or a dumping motion. Operating the operation device 4 to perform bucket excavation causes the bucket cylinder 23 to extend and the bucket 13 to perform the excavation motion. Operating the operation device 4 to perform bucket dumping causes the bucket cylinder 23 to retract and the bucket 13 to perform the dumping motion.

[Hydraulic System]

Figure 3:
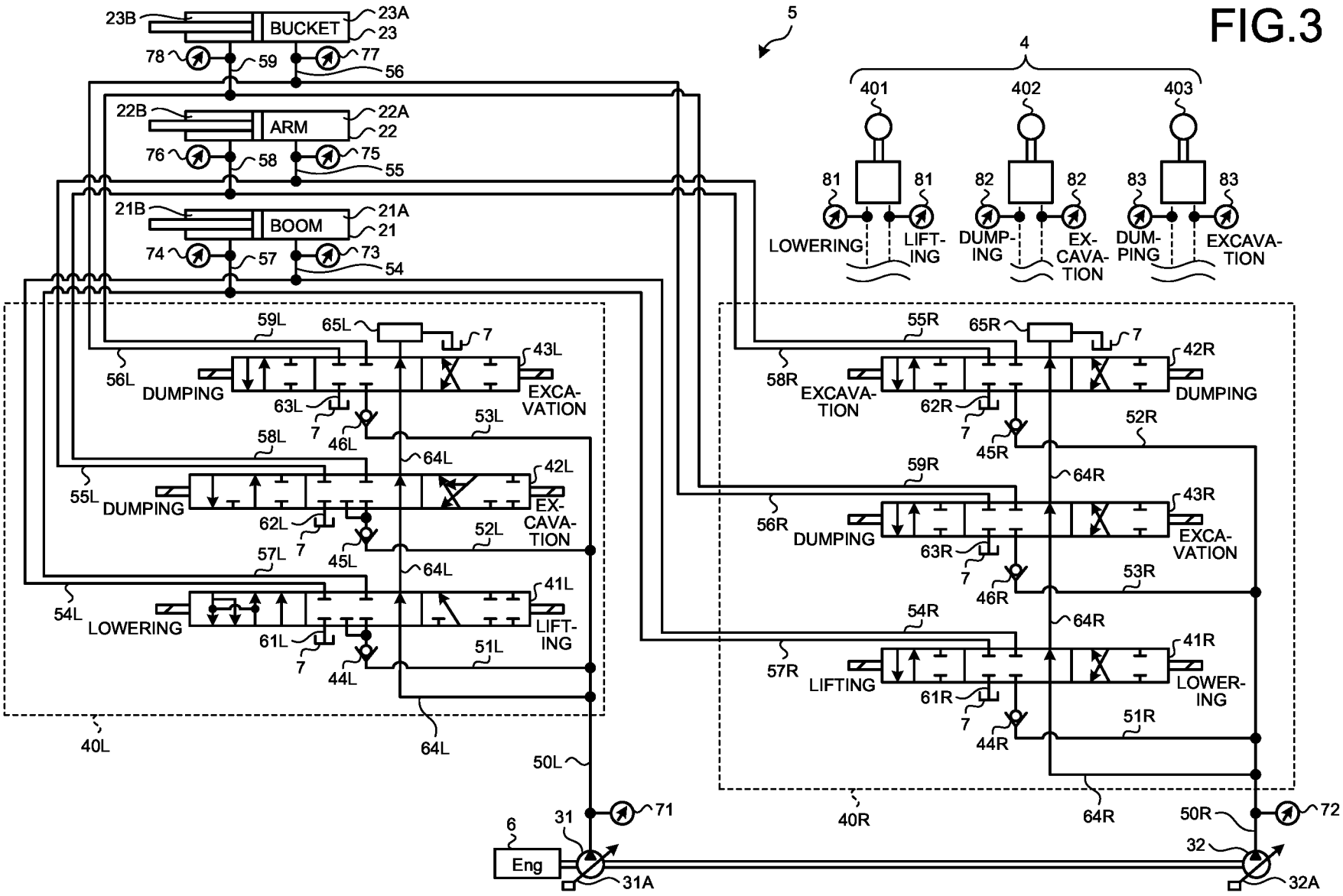
FIG. 3 is a schematic diagram illustrating a hydraulic system of the excavator according to the embodiment.

FIG. 3 is a schematic diagram illustrating a hydraulic system 5 of the excavator 1 according to the embodiment. As illustrated in FIG. 3, the hydraulic system 5 includes an engine 6, a first hydraulic pump 31, a second hydraulic pump 32, the boom cylinder 21, the arm cylinder 22, the bucket cylinder 23, the operation device 4, a first boom operation valve 41L, a first arm operation valve 42L, a first bucket operation valve 43L, a second boom operation valve 41R, a second arm operation valve 42R, a second bucket operation valve 43R, and a tank 7.

The engine 6 is a power source of the excavator 1. A diesel engine is exemplified as the engine 6.

Each of the first hydraulic pump 31 and the second hydraulic pump 32 discharges hydraulic oil. Each of the first hydraulic pump 31 and the second hydraulic pump 32 is driven by power generated by the engine 6. In the embodiment, each of the first hydraulic pump 31 and the second hydraulic pump 32 is a variable displacement hydraulic pump. The first hydraulic pump 31 includes a swash plate 31A driven to change the capacity of the first hydraulic pump 31. The second hydraulic pump 32 includes a swash plate 32A driven to change the capacity of the second hydraulic pump 32.

The boom cylinder 21 includes a bottom chamber 21A and a rod chamber 21B. When hydraulic oil is supplied to the bottom chamber 21A, the boom cylinder 21 extends. When hydraulic oil is supplied to the rod chamber 21B, the boom cylinder 21 retracts.

The arm cylinder 22 includes a bottom chamber 22A and a rod chamber 22B. When hydraulic oil is supplied to the bottom chamber 22A, the arm cylinder 22 extends. When hydraulic oil is supplied to the rod chamber 22B, the arm cylinder 22 retracts.

The bucket cylinder 23 includes a bottom chamber 23A and a rod chamber 23B. When hydraulic oil is supplied to the bottom chamber 23A, the bucket cylinder 23 extends. When hydraulic oil is supplied to the rod chamber 23B, the bucket cylinder 23 retracts.

The operation device 4 is operated by the operator to actuate at least one of the boom cylinder 21, the arm cylinder 22, and the bucket cylinder 23. In the example illustrated in FIG. 3, the operation device 4 includes a boom work lever 401 operated to actuate the boom cylinder 21, an arm work lever 402 operated to actuate the arm cylinder 22, and a bucket work lever 403 operated to actuate the bucket cylinder 23. The operation device 4 illustrated in FIG. 3 is an example. The operation device 4 may have two work levers. The boom cylinder 21 may be actuated by operating one of the work levers in a front-rear direction, and the bucket cylinder 23 may be actuated by operating the work lever in a left-right direction. The arm cylinder 22 may be actuated by operating the other work lever in the left-right direction.

The first boom operation valve 41L is connected to the first hydraulic pump 31. The first boom operation valve 41L controls passing of hydraulic oil from the first hydraulic pump 31 to the boom cylinder 21. The first boom operation valve 41L controls a flow rate and a direction of hydraulic oil to be supplied from the first hydraulic pump 31 to the boom cylinder 21.

The first arm operation valve 42L is connected to the first hydraulic pump 31. The first arm operation valve 42L controls passing of hydraulic oil from the first hydraulic pump 31 to the arm cylinder 22. The first arm operation valve 42L controls a flow rate and a direction of hydraulic oil to be supplied from the first hydraulic pump 31 to the arm cylinder 22.

The first bucket operation valve 43L is connected to the first hydraulic pump 31. The first bucket operation valve 43L controls passing of hydraulic oil from the first hydraulic pump 31 to the bucket cylinder 23. The first bucket operation valve 43L controls a flow rate and a direction of hydraulic oil to be supplied from the first hydraulic pump 31 to the bucket cylinder 23.

The second boom operation valve 41R is connected to the second hydraulic pump 32. The second boom operation valve 41R controls passing of hydraulic oil from the second hydraulic pump 32 to the boom cylinder 21. The second boom operation valve 41R controls a flow rate and a direction of hydraulic oil to be supplied from the second hydraulic pump 32 to the boom cylinder 21.

The second arm operation valve 42R is connected to the second hydraulic pump 32. The second arm operation valve 42R controls passing of hydraulic oil from the second hydraulic pump 32 to the arm cylinder 22. The second arm operation valve 42R controls a flow rate and a direction of hydraulic oil to be supplied from the second hydraulic pump 32 to the arm cylinder 22.

The second bucket operation valve 43R is connected to the second hydraulic pump 32. The second bucket operation valve 43R controls passing of hydraulic oil from the second hydraulic pump 32 to the bucket cylinder 23. The second bucket operation valve 43R controls a flow rate and a direction of hydraulic oil to be supplied from the second hydraulic pump 32 to the bucket cylinder 23.

Each of the first boom operation valve 41L and the second boom operation valve 41R is a slide spool type operation valve that controls the flow rate and direction of hydraulic oil to be supplied to the boom cylinder 21 by moving a rod-shaped spool. When the spool moves in an axial direction, the supply of hydraulic oil to the bottom chamber 21A and the supply of hydraulic oil to the rod chamber 21B of the boom cylinder 21 switch. In addition, the flow rate of hydraulic oil to be supplied to the boom cylinder 21 is adjusted based on the movement amount of the spool.

Each of the first arm operation valve 42L and the second arm operation valve 42R is also a slide spool type flow rate operation valve. When the spool moves in the axial direction, the supply of hydraulic oil to the bottom chamber 22A and the supply of hydraulic oil to the rod chamber 22B of the arm cylinder 22 switch. In addition, the flow rate of hydraulic oil to be supplied to the arm cylinder 22 is adjusted based on the movement amount of the spool.

Each of the first bucket operation valve 43L and the second bucket operation valve 43R is also a slide spool type flow rate operation valve. When the spool moves in the axial direction, the supply of hydraulic oil to the bottom chamber 23A and the supply of hydraulic oil to the rod chamber 23B of the bucket cylinder 23 switch. In addition, the flow rate of hydraulic oil to be supplied to the bucket cylinder 23 is adjusted based on the movement amount of the spool.

The first boom operation valve 41L, the first arm operation valve 42L, and the first bucket operation valve 43L constitute a first operation valve group 40L connected to the first hydraulic pump 31.

The second boom operation valve 41R, the second arm operation valve 42R, and the second bucket operation valve 43R constitute a second operation valve group 40R connected to the second hydraulic pump 32.

The first boom operation valve 41L is connected to the first hydraulic pump 31 via an ejection flow path 50L and a supply flow path 51L. The first arm operation valve 42L is connected to the first hydraulic pump 31 via the ejection flow path 50L and a supply flow path 52L. The first bucket operation valve 43L is connected to the first hydraulic pump 31 via the ejection flow path 50L and a supply flow path 53L. The ejection flow path 50L is connected to an ejection port of the first hydraulic pump 31. The supply flow path 51L, the supply flow path 52L, and the supply flow path 53L are connected in parallel to the ejection flow path 50L.

The second boom operation valve 41R is connected to the second hydraulic pump 32 via an ejection flow path 50R and a supply flow path 51R. The second arm operation valve 42R is connected to the second hydraulic pump 32 via the ejection flow path 50R and a supply flow path 52R. The second bucket operation valve 43R is connected to the second hydraulic pump 32 via the ejection flow path 50R and a supply flow path 53R. The ejection flow path 50R is connected to an ejection port of the second hydraulic pump 32. The supply flow path 51R, the supply flow path 52R, and the supply flow path 53R are connected in parallel to the ejection flow path 50R.

The first boom operation valve 41L is connected to the bottom chamber 21A of the boom cylinder 21 via a bottom flow path 54 and a bottom flow path 54L. The second boom operation valve 41R is connected to the bottom chamber 21A of the boom cylinder 21 via the bottom flow path 54 and a bottom flow path 54R. The bottom flow path 54 is connected to the bottom chamber 21A. The bottom flow path 54L is connected to the first boom operation valve 41L. The bottom flow path 54R is connected to the second boom operation valve 41R.

The first arm operation valve 42L is connected to the bottom chamber 22A of the arm cylinder 22 via a bottom flow path 55 and a bottom flow path 55L. The second arm operation valve 42R is connected to the bottom chamber 22A of the arm cylinder 22 via the bottom flow path 55 and a bottom flow path 55R. The bottom flow path 55 is connected to the bottom chamber 22A. The bottom flow path 55L is connected to the first arm operation valve 42L. The bottom flow path 55R is connected to the second arm operation valve 42R.

The first bucket operation valve 43L is connected to the bottom chamber 23A of the bucket cylinder 23 via a bottom flow path 56 and a bottom flow path 56L. The second bucket operation valve 43R is connected to the bottom chamber 23A of the bucket cylinder 23 via the bottom flow path 56 and a bottom flow path 56R. The bottom flow path 56 is connected to the bottom chamber 23A. The bottom flow path 56L is connected to the first bucket operation valve 43L. The bottom flow path 56R is connected to the second bucket operation valve 43R.

The first boom operation valve 41L is connected to the rod chamber 21B of the boom cylinder 21 via a rod flow path 57 and a rod flow path 57L. The second boom operation valve 41R is connected to the rod chamber 21B of the boom cylinder 21 via the rod flow path 57 and a rod flow path 57R. The rod flow path 57 is connected to the rod chamber 21B. The rod flow path 57L is connected to the first boom operation valve 41L. The rod flow path 57R is connected to the second boom operation valve 41R.

The first arm operation valve 42L is connected to the rod chamber 22B of the arm cylinder 22 via a rod flow path 58 and a rod flow path 58L. The second arm operation valve 42R is connected to the rod chamber 22B of the arm cylinder 22 via the rod flow path 58 and a rod flow path 58R. The rod flow path 58 is connected to the rod chamber 22B. The rod flow path 58L is connected to the first arm operation valve 42L. The rod flow path 58R is connected to the second arm operation valve 42R.

The first bucket operation valve 43L is connected to the rod chamber 23B of the bucket cylinder 23 via a rod flow path 59 and a rod flow path 59L. The second bucket operation valve 43R is connected to the rod chamber 23B of the bucket cylinder 23 via the rod flow path 59 and a rod flow path 59R. The rod flow path 59 is connected to the rod chamber 23B. The rod flow path 59L is connected to the first bucket operation valve 43L. The rod flow path 59R is connected to the second bucket operation valve 43R.

The spool of the first boom operation valve 41L and the spool of the second boom operation valve 41R move to a bottom chamber supply position for letting hydraulic oil to be supplied to the bottom chamber 21A of the boom cylinder 21 pass, a rod chamber supply position for letting hydraulic oil to be supplied to the rod chamber 21B of the boom cylinder 21 pass, and a neutral position for not letting hydraulic oil pass. In the example illustrated in FIG. 3, the spool of the first boom operation valve 41L and the spool of the second boom operation valve 41R are disposed at the neutral positions.

The spool of the first arm operation valve 42L and the spool of the second arm operation valve 42R move to a bottom chamber supply position for letting hydraulic oil to be supplied to the bottom chamber 22A of the arm cylinder 22 pass, a rod chamber supply position for letting hydraulic oil to be supplied to the rod chamber 22B of the arm cylinder 22 pass, and a neutral position for not letting hydraulic oil pass. In the example illustrated in FIG. 3, the spool of the first arm operation valve 42L and the spool of the second arm operation valve 42R are disposed at the neutral positions.

The spool of the first bucket operation valve 43L and the spool of the second bucket operation valve 43R move to a bottom chamber supply position for letting hydraulic oil to be supplied to the bottom chamber 23A of the bucket cylinder 23 pass, a rod chamber supply position for letting hydraulic oil to be supplied to the rod chamber 23B of the bucket cylinder 23 pass, and a neutral position for not letting hydraulic oil pass. In the example illustrated in FIG. 3, the spool of the first bucket operation valve 43L and the spool of the second bucket operation valve 43R are disposed at the neutral positions.

The first boom operation valve 41L is connected to the tank 7 via a discharge flow path 61L. The hydraulic oil supplied from the boom cylinder 21 to the first boom operation valve 41L is supplied to the tank 7 via the discharge flow path 61L. The second boom operation valve 41R is connected to the tank 7 via a discharge flow path 61R. The hydraulic oil supplied from the boom cylinder 21 to the second boom operation valve 41R is supplied to the tank 7 via the discharge flow path 61R.

The first arm operation valve 42L is connected to the tank 7 via a discharge flow path 62L. The hydraulic oil supplied from the arm cylinder 22 to the first arm operation valve 42L is supplied to the tank 7 via the discharge flow path 62L. The second arm operation valve 42R is connected to the tank 7 via a discharge flow path 62R. The hydraulic oil supplied from the arm cylinder 22 to the second arm operation valve 42R is supplied to the tank 7 via the discharge flow path 62R.

The first bucket operation valve 43L is connected to the tank 7 via a discharge flow path 63L. The hydraulic oil supplied from the bucket cylinder 23 to the first bucket operation valve 43L is supplied to the tank 7 via the discharge flow path 63L. The second bucket operation valve 43R is connected to the tank 7 via a discharge flow path 63R. The hydraulic oil supplied from the bucket cylinder 23 to the second bucket operation valve 43R is supplied to the tank 7 via the discharge flow path 63R.

The first hydraulic pump 31, the first boom operation valve 41L, the first arm operation valve 42L, and the first bucket operation valve 43L are connected via a neutral flow path 64L. The neutral flow path 64L is connected to the tank 7 via a negative control mechanism 65L that negatively controls the capacity of the first hydraulic pump 31. In a state where each of the spool of the first boom operation valve 41L, the spool of the first arm operation valve 42L, and the spool of the first bucket operation valve 43L is disposed at the neutral position, the hydraulic oil ejected from the first hydraulic pump 31 is supplied to the tank 7 via the first boom operation valve 41L, the first arm operation valve 42L, the first bucket operation valve 43L, and the neutral flow path 64L.

The second hydraulic pump 32, the second boom operation valve 41R, the second arm operation valve 42R, and the second bucket operation valve 43R are connected via a neutral flow path 64R. The neutral flow path 64R is connected to the tank 7 via a negative control mechanism 65R that negatively controls the capacity of the second hydraulic pump 32. In a state where each of the spool of the second boom operation valve 41R, the spool of the second arm operation valve 42R, and the spool of the second bucket operation valve 43R is disposed at the neutral position, the hydraulic oil discharged from the second hydraulic pump 32 is supplied to the tank 7 via the second boom operation valve 41R, the second arm operation valve 42R, the second bucket operation valve 43R, and the neutral flow path 64R.

A plurality of tanks 7 are illustrated in FIG. 3, but the number of the tank 7 may be one.

A boom check valve 44L is disposed in the supply flow path 51L. An arm check valve 45L is disposed in the supply flow path 52L. A bucket check valve 46L is disposed in the supply flow path 53L.

The boom check valve 44L prevents backflow of hydraulic oil from the boom cylinder 21 to the first hydraulic pump 31 via the first boom operation valve 41L. The arm check valve 45L prevents backflow of hydraulic oil from the arm cylinder 22 to the first hydraulic pump 31 via the first arm operation valve 42L. The bucket check valve 46L prevents backflow of hydraulic oil from the bucket cylinder 23 to the first hydraulic pump 31 via the first bucket operation valve 43L.

A boom check valve 44R is disposed in the supply flow path 51R. An arm check valve 45R is disposed in the supply flow path 52R. A bucket check valve 46R is disposed in the supply flow path 53R.

The boom check valve 44R prevents backflow of hydraulic oil from the boom cylinder 21 to the second hydraulic pump 32 via the second boom operation valve 41R. The arm check valve 45R prevents backflow of hydraulic oil from the arm cylinder 22 to the second hydraulic pump 32 via the second arm operation valve 42R. The bucket check valve 46R prevents backflow of hydraulic oil from the bucket cylinder 23 to the second hydraulic pump 32 via the second bucket operation valve 43R.

The hydraulic system 5 further includes a first ejection pressure sensor 71, a second ejection pressure sensor 72, a boom bottom pressure sensor 73, a boom rod pressure sensor 74, an arm bottom pressure sensor 75, an arm rod pressure sensor 76, a bucket bottom pressure sensor 77, and a bucket rod pressure sensor 78.

The first ejection pressure sensor 71 detects a first ejection pressure indicating the pressure of the hydraulic oil ejected from the first hydraulic pump 31. The first ejection pressure sensor 71 is disposed at the ejection port of the first hydraulic pump 31.

The second ejection pressure sensor 72 detects a second ejection pressure indicating the pressure of the hydraulic oil ejected from the second hydraulic pump 32. The second ejection pressure sensor 72 is disposed at the ejection port of the second hydraulic pump 32.

The boom bottom pressure sensor 73 detects a boom bottom pressure indicating the pressure of the bottom chamber 21A of the boom cylinder 21. The boom bottom pressure sensor 73 is disposed in the bottom flow path 54.

The boom rod pressure sensor 74 detects a boom rod pressure indicating the pressure of the rod chamber 21B of the boom cylinder 21. The boom rod pressure sensor 74 is disposed in the rod flow path 57.

The arm bottom pressure sensor 75 detects an arm bottom pressure indicating the pressure of the bottom chamber 22A of the arm cylinder 22. The arm bottom pressure sensor 75 is disposed in the bottom flow path 55.

The arm rod pressure sensor 76 detects an arm rod pressure indicating the pressure of the rod chamber 22B of the arm cylinder 22. The arm rod pressure sensor 76 is disposed in the rod flow path 58.

The bucket bottom pressure sensor 77 detects a bucket bottom pressure indicating the pressure of the bottom chamber 23A of the bucket cylinder 23. The bucket bottom pressure sensor 77 is disposed in the bottom flow path 56.

The bucket rod pressure sensor 78 detects a bucket rod pressure indicating the pressure of the rod chamber 23B of the bucket cylinder 23. The bucket rod pressure sensor 78 is disposed in the rod flow path 59.

The hydraulic system 5 further includes a boom operation amount sensor 81, an arm operation amount sensor 82, and a bucket operation amount sensor 83.

The boom operation amount sensor 81 detects a boom operation amount indicating an operation amount of the operation device 4 in operating the boom cylinder 21. In the embodiment, a pressure proportional control (PPC) valve is provided in the boom work lever 401. The PPC valve generates a pilot pressure based on an operation angle of the boom work lever 401. The boom operation amount sensor 81 is a pressure sensor that detects a PPC pressure indicating a pilot pressure generated by the PPC valve based on an operation angle of the boom work lever 401 as the boom operation amount. Two boom operation amount sensors 81 are provided. One boom operation amount sensor 81 detects a boom lifting operation amount indicating a boom operation amount when the boom lifting operation is performed. The other boom operation amount sensor 81 detects a boom lowering operation amount indicating a boom operation amount when the boom lowering operation is performed.

The arm operation amount sensor 82 detects an arm operation amount indicating an operation amount of the operation device 4 in operating the arm cylinder 22. A PPC valve is provided in the arm work lever 402 as in the boom work lever 401. The arm operation amount sensor 82 is a pressure sensor that detects a PPC pressure indicating a pilot pressure generated by the PPC valve based on an operation angle of the arm work lever 402 as the arm operation amount. Two arm operation amount sensors 82 are provided. One arm operation amount sensor 82 detects an arm excavation operation amount indicating an arm operation amount when the arm excavation operation is performed. The other arm operation amount sensor 82 detects an arm dumping operation amount indicating an arm operation amount when the arm dumping operation is performed.

The bucket operation amount sensor 83 detects a bucket operation amount indicating an operation amount of the operation device 4 in operating the bucket cylinder 23. A PPC valve is provided in the bucket work lever 403 as in the boom work lever 401 and the arm work lever 402. The bucket operation amount sensor 83 is a pressure sensor that detects a PPC pressure indicating a pilot pressure generated by the PPC valve based on an operation angle of the bucket work lever 403 as the bucket operation amount. Two bucket operation amount sensors 83 are provided. One bucket operation amount sensor 83 detects a bucket excavation operation amount indicating a bucket operation amount when the bucket excavation operation is performed. The other bucket operation amount sensor 83 detects a bucket dumping operation amount indicating a bucket operation amount when the bucket dumping operation is performed.

The boom operation amount sensor 81 may be an angle sensor that detects an operation angle of the boom work lever 401 as the boom operation amount. The arm operation amount sensor 82 may be an angle sensor that detects an operation angle of the arm work lever 402 as the arm operation amount. The bucket operation amount sensor 83 may be an angle sensor that detects an operation angle of the bucket work lever 403 as the bucket operation amount.

[Control Device]

Figure 4:
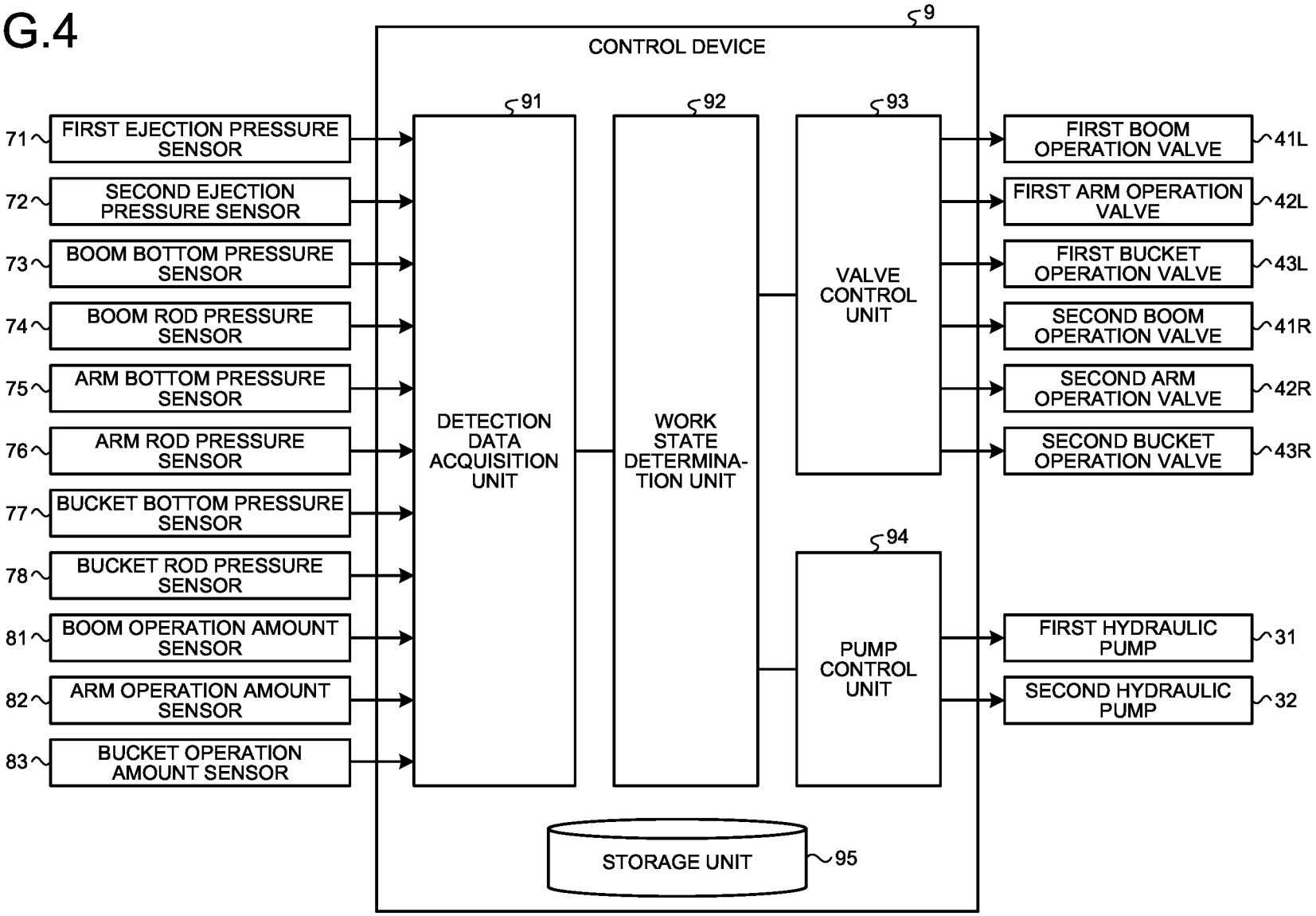
FIG. 4 is a functional block diagram illustrating a control device of the excavator according to the embodiment.

FIG. 4 is a functional block diagram illustrating a control device 9 of the excavator 1 according to the embodiment. The control device 9 is mounted on the excavator 1. The control device 9 controls the hydraulic system 5. The control device 9 includes a computer system.

The control device 9 is connected to each of the first ejection pressure sensor 71, the second ejection pressure sensor 72, the boom bottom pressure sensor 73, the boom rod pressure sensor 74, the arm bottom pressure sensor 75, the arm rod pressure sensor 76, the bucket bottom pressure sensor 77, the bucket rod pressure sensor 78, the boom operation amount sensor 81, the arm operation amount sensor 82, and the bucket operation amount sensor 83 via a communication line. The control device 9 is connected to each of the first hydraulic pump 31, the second hydraulic pump 32, the first boom operation valve 41L, the second boom operation valve 41R, the first arm operation valve 42L, the second arm operation valve 42R, the first bucket operation valve 43L, and the second bucket operation valve 43R via a control line.

The control device 9 includes a detection data acquisition unit 91, a work state determination unit 92, a valve control unit 93, a pump control unit 94, and a storage unit 95.

The detection data acquisition unit 91 acquires detection data of the first ejection pressure sensor 71, detection data of the second ejection pressure sensor 72, detection data of the boom bottom pressure sensor 73, detection data of the boom rod pressure sensor 74, detection data of the arm bottom pressure sensor 75, detection data of the arm rod pressure sensor 76, detection data of the bucket bottom pressure sensor 77, detection data of the bucket rod pressure sensor 78, detection data of the boom operation amount sensor 81, detection data of the arm operation amount sensor 82, and detection data of the bucket operation amount sensor 83.

The work state determination unit 92 determines the work state of the working equipment 10. The work state of the working equipment 10 includes a normal state and a heavy excavation state.

The normal state refers to a state in which the bucket 13 excavates an excavation object with an excavation load smaller than a predetermined excavation load or a state in which the working equipment 10 does not excavate an excavation object. In the normal state, the excavation reaction force acting on the working equipment 10 is smaller than the gravity acting on the working equipment 10. In the normal state, the boom bottom pressure is higher than the arm bottom pressure and the bucket bottom pressure.

The heavy excavation state refers to a state in which the bucket 13 excavates an excavation object with an excavation load higher than a predetermined excavation load. In the heavy excavation state, a large excavation reaction force acts on the working equipment 10. In the heavy excavation state, the boom bottom pressure is lower than the arm bottom pressure and the bucket bottom pressure.

For example, in an excavation work, the normal state in which the boom bottom pressure is higher than the arm bottom pressure and the bucket bottom pressure and the heavy excavation state in which the boom bottom pressure is lower than the arm bottom pressure and the bucket bottom pressure switch.

The work state determination unit 92 can determine the work state of the working equipment 10 based on the operation state of the operation device 4, the boom bottom pressure, the arm bottom pressure, and the bucket bottom pressure. The work state determination unit 92 can determine the work state of the working equipment 10 based on the detection data of the arm operation amount sensor 82, the detection data of the bucket operation amount sensor 83, the detection data of the arm bottom pressure sensor 75, and the detection data of the bucket bottom pressure sensor 77.

In the embodiment, the normal state refers to a work state in which the arm excavation operation amount of the operation device 4 is equal to or larger than a first threshold R1 or the bucket excavation operation amount is equal to or larger than a second threshold R2, and the boom bottom pressure is higher than the higher value of the arm bottom pressure and the bucket bottom pressure.

In the embodiment, the heavy excavation state refers to a work state in which the arm excavation operation amount of the operation device 4 is equal to or larger than the first threshold R1 or the bucket excavation operation amount is equal to or larger than the second threshold R2, and the higher value of the arm bottom pressure and the bucket bottom pressure is higher than the boom bottom pressure.

Figure 5:
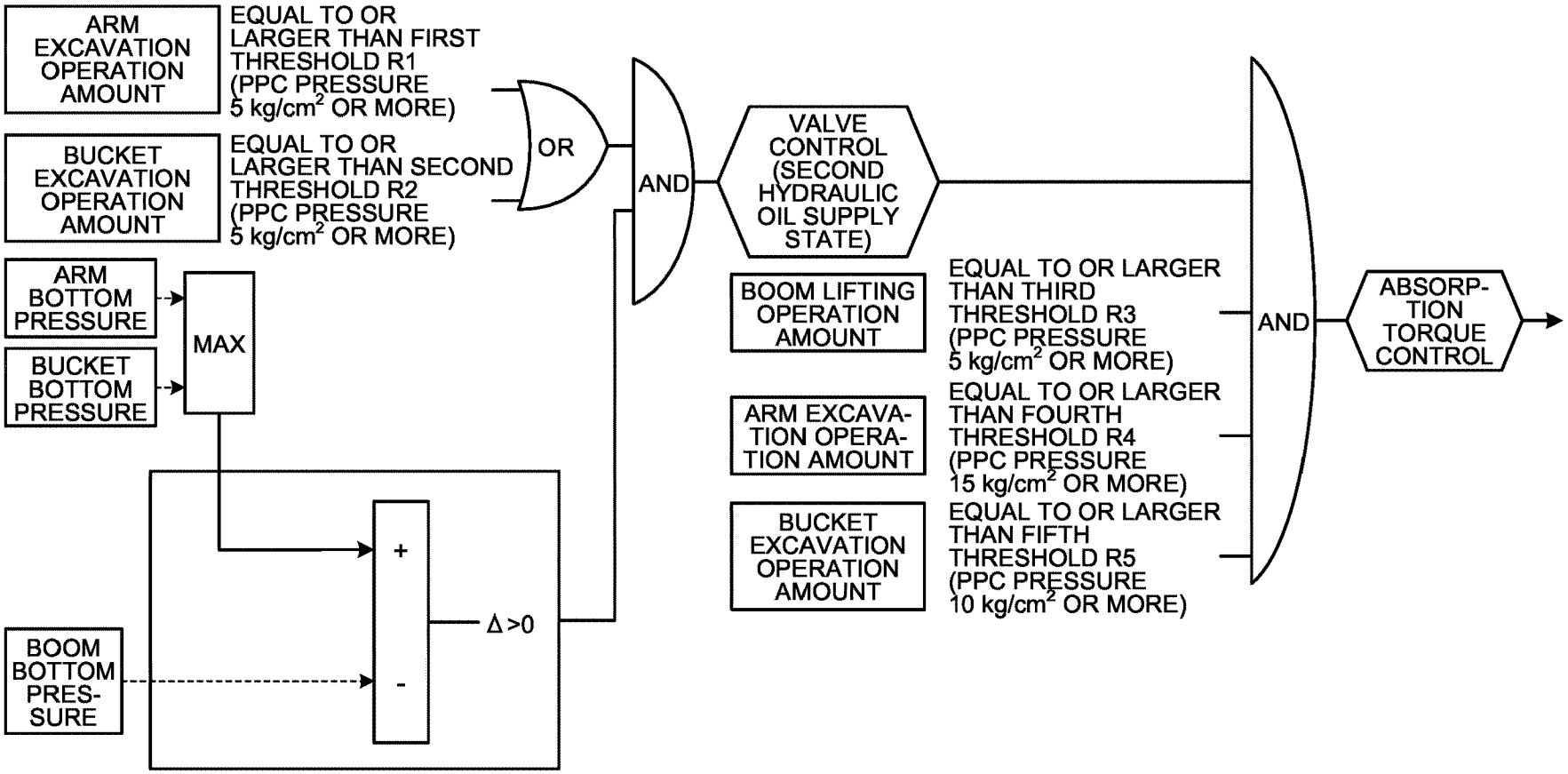
FIG. 5 is a schematic diagram illustrating a determination method of a work state determination unit according to the embodiment.

FIG. 5 is a schematic diagram illustrating a determination method of the work state determination unit 92 according to the embodiment. The work state determination unit 92 can determine whether the arm excavation operation is performed based on the detection data of the arm operation amount sensor 82. The work state determination unit 92 can also acquire the arm excavation operation amount indicating the arm excavation operation amount when the arm excavation operation of the operation device 4 is performed based on the detection data of the arm operation amount sensor 82. The work state determination unit 92 can also determine whether the bucket excavation operation is performed based on the detection data of the bucket operation amount sensor 83. The work state determination unit 92 can also acquire the bucket excavation operation amount indicating the bucket operation amount when the bucket excavation operation of the operation device 4 is performed based on the detection data of the bucket operation amount sensor 83.

The work state determination unit 92 determines that the work state of the working equipment 10 is the heavy excavation state when a heavy excavation determination condition is satisfied in which the arm excavation operation amount is equal to or larger than the first threshold R1 or the bucket excavation operation amount is equal to or larger than the second threshold R2 and the higher value of the arm bottom pressure and the bucket bottom pressure is higher than the boom bottom pressure. Each of the first threshold R1 and the second threshold R2 is a predetermined value and is stored in the storage unit 95.

The first threshold R1 is a threshold related to the PPC pressure of the arm work lever 402. The second threshold R2 is a threshold related to the PPC pressure of the bucket work lever 403. As an example, each of the first threshold R1 and the second threshold R2 is 5 kg/cm$^2$. Each of the first threshold R1 and the second threshold R2 is a low value. Immediately after the operation of the arm work lever 402 is started, the arm excavation operation amount exceeds the first threshold R1. Immediately after the operation of the bucket work lever 403 is started, the bucket excavation operation amount exceeds the second threshold R2. The work state determination unit 92 can determine that the arm excavation operation is started when the arm excavation operation amount becomes equal to or larger than the first threshold R1. The work state determination unit 92 can determine that the bucket excavation operation is started when the bucket excavation operation amount becomes equal to or larger than the second threshold R2.

When determining that the heavy excavation determination condition is not satisfied, the work state determination unit 92 determines that the work state of the working equipment 10 is the normal state.

The valve control unit 93 controls at least one of the first boom operation valve 41L, the first arm operation valve 42L, the first bucket operation valve 43L, the second boom operation valve 41R, the second arm operation valve 42R, and the second bucket operation valve 43R based on the work state of the working equipment 10 determined by the work state determination unit 92. When it is determined that the work state of the working equipment 10 is the normal state, the valve control unit 93 performs valve control to cause the hydraulic system 5 to enter a first hydraulic oil supply state. When it is determined that the work state of the working equipment 10 is the heavy excavation state, the valve control unit 93 performs valve control to cause the hydraulic system 5 to enter a second hydraulic oil supply state different from the first hydraulic oil supply state.

The pump control unit 94 controls the first hydraulic pump 31 and the second hydraulic pump 32 based on the work state of the working equipment 10 determined by the work state determination unit 92. In the embodiment, the pump control unit 94 controls the absorption torque of the first hydraulic pump 31 and the absorption torque of the second hydraulic pump 32 based on the work state of the working equipment 10 and the operation state of the operation device 4.

When it is determined that the work state of the working equipment 10 is in the normal state, the pump control unit 94 equalizes the upper limit of the absorption torque of the first hydraulic pump 31 and the upper limit of the absorption torque of the second hydraulic pump 32. When it is determined that the boom lifting operation amount is equal to or larger than a third threshold R3 with the work state of the working equipment 10 being the heavy excavation state, the pump control unit 94 makes the upper limit of the absorption torque of the first hydraulic pump 31 higher than the upper limit of the absorption torque of the second hydraulic pump 32. The third threshold R3 is a predetermined value and is stored in the storage unit 95.

The third threshold R3 is a threshold related to the PPC pressure of the boom work lever 401. As an example, the third threshold R3 is 5 kg/cm$^2$. The third threshold R3 is a low value. Immediately after the operation of the boom work lever 401 is started, the boom lifting operation amount exceeds the third threshold R3. The work state determination unit 92 can determine that the boom lifting operation is started when the boom lifting operation amount becomes equal to or larger than the third threshold R3.

In the heavy excavation state in which the excavation load applied to the working equipment 10 is high, the operator often performs the boom lifting operation so that the excavation load applied to the bucket 13 and the arm 12 decreases. When determining that the boom lifting operation amount is equal to or larger than the third threshold R3 with the work state of the working equipment 10 being the heavy excavation state, the pump control unit 94 drives at least one of the swash plate 31A and the swash plate 32A to make the upper limit of the absorption torque of the first hydraulic pump 31 higher than the upper limit of the absorption torque of the second hydraulic pump 32.

The work state determination unit 92 can determine whether the boom lifting operation amount is equal to or larger than the third threshold R3 based on the detection data of the boom operation amount sensor 81. As illustrated in FIG. 5, when determining that the heavy excavation determination condition is satisfied and the boom lifting operation amount is equal to or larger than the third threshold R3, the pump control unit 94 performs absorption torque control such that the upper limit of the absorption torque of the first hydraulic pump 31 becomes higher than the upper limit of the absorption torque of the second hydraulic pump 32.

The absorption torque Tp [kgm] of the hydraulic pump is typically expressed by the following Formula (1).

$$Tp=q\times P/(200\times\pi)/\eta t \quad (1)$$

In Formula (1), Tp is the absorption torque [kgm] of the hydraulic pump, q is the capacity [cc/rev] of the hydraulic pump, P is the ejection pressure [kg/cm2] of the hydraulic oil ejected from the hydraulic pump, and ηt is the torque efficiency of the hydraulic pump.

The capacity q of the first hydraulic pump 31 is adjusted by changing the angle of the swash plate 31A of the first hydraulic pump 31. The capacity q of the second hydraulic pump 32 is adjusted by changing the angle of the swash plate 32A of the second hydraulic pump 32. The first ejection pressure indicating the ejection pressure P of the first hydraulic pump 31 is detected by the first ejection pressure sensor 71. The second ejection pressure indicating the ejection pressure P of the second hydraulic pump 32 is detected by the second ejection pressure sensor 72. The torque efficiency it is an eigenvalue of each of the first hydraulic pump 31 and the second hydraulic pump 32 and is known data.

Thus, when the absorption torque Tp of the first hydraulic pump 31 is an absorption torque Tp1, and the absorption torque Tp of the second hydraulic pump 32 is an absorption torque Tp2, the pump control unit 94 can control the absorption torque Tp1 of the first hydraulic pump 31 by adjusting the angle of the swash plate 31A based on the detection data of the first ejection pressure sensor 71. The pump control unit 94 can control the absorption torque Tp2 of the second hydraulic pump 32 by adjusting the angle of the swash plate 32A based on the detection data of the second ejection pressure sensor 72.

When it is determined that the work state of the working equipment 10 is the normal state, the pump control unit 94 adjusts the angle of at least one of the swash plate 31A and the swash plate 32A such that the upper limit of the absorption torque Tp1 of the first hydraulic pump 31 is equal to the upper limit of the absorption torque Tp2 of the second hydraulic pump 32 based on the detection data of the first ejection pressure sensor 71 and the detection data of the second ejection pressure sensor 72. That is, the pump control unit 94 adjusts the capacity q of the first hydraulic pump 31 and the capacity q of the second hydraulic pump 32 such that the proportion between the upper limit of the absorption torque Tp1 and the upper limit of the absorption torque Tp2 becomes [Tp1:Tp2=50:50].

When it is determined that the boom lifting operation amount is equal to or larger than the third threshold R3 with the work state of the working equipment 10 being the heavy excavation state, the pump control unit 94 adjusts the angle of at least one of the swash plate 31A and the swash plate 32A such that the upper limit of the absorption torque Tp1 of the first hydraulic pump 31 is higher than the upper limit of the absorption torque Tp2 of the second hydraulic pump 32 based on the detection data of the first ejection pressure sensor 71 and the detection data of the second ejection pressure sensor 72. In the embodiment, the pump control unit 94 adjusts the capacity q of the first hydraulic pump 31 and the capacity q of the second hydraulic pump 32 such that, for example, the proportion between the upper limit of the absorption torque Tp1 and the upper limit of the absorption torque Tp2 is [Tp1:Tp2=90:10].

In the embodiment, the pump control unit 94 performs absorption torque control in consideration of not only the boom lifting operation amount but also the arm excavation operation amount and the bucket excavation operation amount. That is, as illustrated in FIG. 5, when it is determined that the boom lifting operation amount is equal to or larger than the third threshold R3, the arm excavation operation amount is equal to or larger than a fourth threshold R4, and the bucket excavation operation amount is equal to or larger than a fifth threshold R5 with the work state of the working equipment 10 being the heavy excavation state, the pump control unit 94 makes the upper limit of the absorption torque of the first hydraulic pump 31 higher than the upper limit of the absorption torque of the second hydraulic pump 32. The work state determination unit 92 can determine whether the arm excavation operation amount is equal to or larger than the fourth threshold R4 based on the detection data of the arm operation amount sensor 82. The work state determination unit 92 can determine whether the bucket excavation operation amount is equal to or larger than the fifth threshold R5 based on the detection data of the bucket operation amount sensor 83.

The fourth threshold R4 is a threshold related to the PPC pressure of the arm work lever 402. The fifth threshold R5 is a threshold related to the PPC pressure of the bucket work lever 403. The fourth threshold R4 is higher than the first threshold R1. The fifth threshold R5 is higher than the second threshold R2. As an example, the fourth threshold R4 is 15 kg/cm$^2$. The fifth threshold R5 is 10 kg/cm$^2$. When the arm work lever 402 is operated to some extent, the arm excavation operation amount exceeds the fourth threshold R4. For example, when the arm work lever 402 is operated from the neutral position by 50% or more of the movable range of the arm work lever 402, the arm excavation operation amount exceeds the fourth threshold R4. The work state determination unit 92 can determine that the arm excavation operation is sufficiently performed when the arm excavation operation amount becomes equal to or larger than the fourth threshold R4. Similarly, when the bucket work lever 403 is operated to some extent, the bucket excavation operation amount exceeds the fifth threshold R5. The work state determination unit 92 can determine that the bucket excavation operation is sufficiently performed when the bucket excavation operation amount becomes equal to or larger than the fifth threshold R5.

Figure 6:
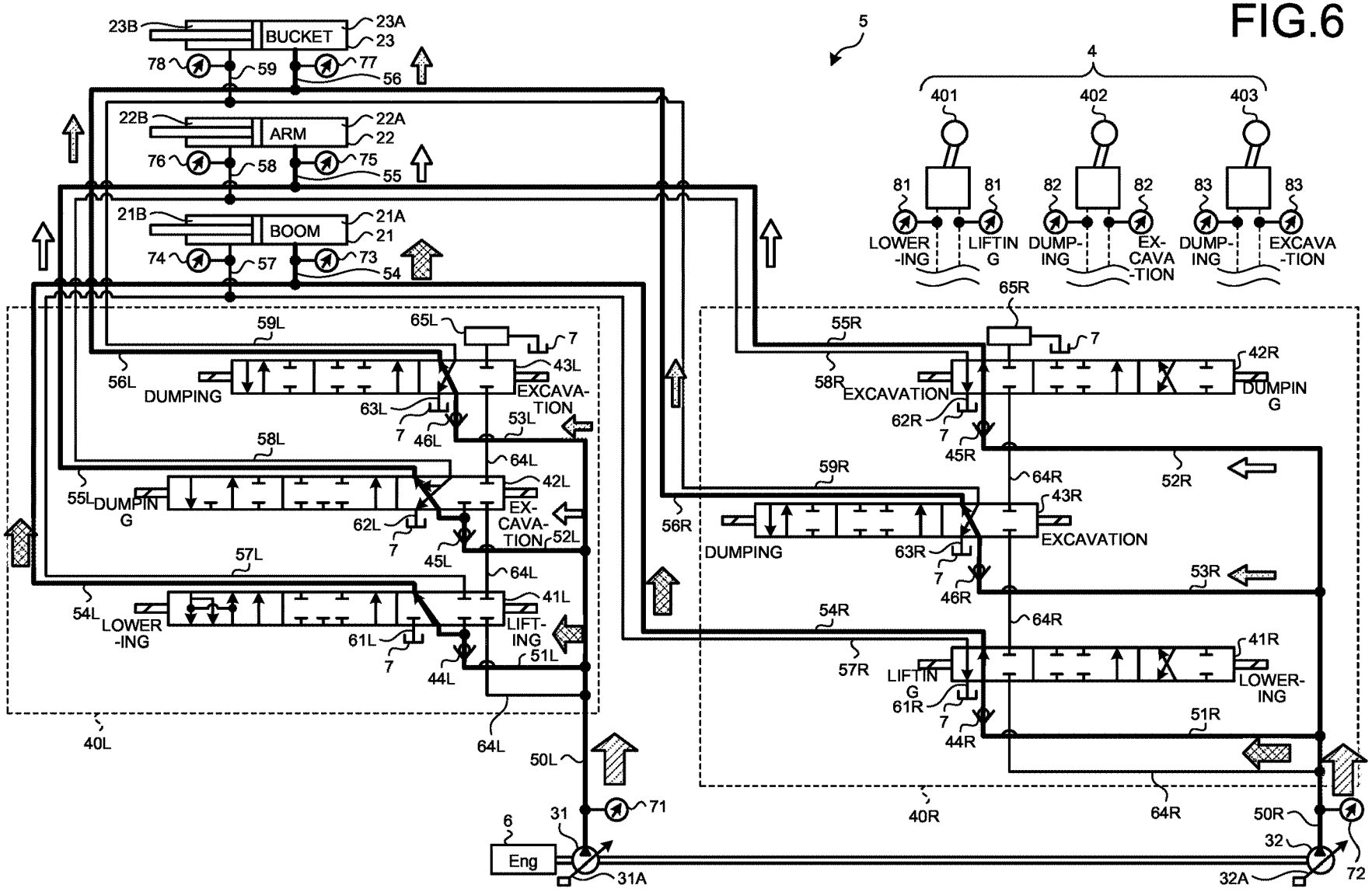
FIG. 6 is a schematic diagram illustrating a hydraulic system when it is determined that a work state of the working equipment according to the embodiment is a normal state.

FIG. 6 is a schematic diagram illustrating the hydraulic system 5 when it is determined that the work state of the working equipment 10 according to the embodiment is the normal state. FIG. 6 illustrates a state in which the hydraulic system 5 is set to the first hydraulic oil supply state.

As illustrated in FIG. 6, when it is determined that the work state of the working equipment 10 is the normal state, the valve control unit 93 controls the first boom operation valve 41L and the second boom operation valve 41R such that hydraulic oil is supplied from both the first hydraulic pump 31 and the second hydraulic pump 32 to the bottom chamber 21A of the boom cylinder 21. When it is determined that the work state of the working equipment 10 is the normal state, the valve control unit 93 controls the first arm operation valve 42L and the second arm operation valve 42R such that hydraulic oil is supplied from both the first hydraulic pump 31 and the second hydraulic pump 32 to the bottom chamber 22A of the arm cylinder 22. When it is determined that the work state of the working equipment 10 is the normal state, the valve control unit 93 controls the first bucket operation valve 43L and the second bucket operation valve 43R such that hydraulic oil is supplied from both the first hydraulic pump 31 and the second hydraulic pump 32 to the bottom chamber 23A of the bucket cylinder 23.

That is, when the work state of the working equipment 10 is the normal state, the valve control unit 93 disposes each spool of the first boom operation valve 41L, the second boom operation valve 41R, the first arm operation valve 42L, the second arm operation valve 42R, the first bucket operation valve 43L, and the second bucket operation valve 43R at the bottom chamber supply position.

A part of the hydraulic oil ejected from the first hydraulic pump 31 passes through the first boom operation valve 41L and then is supplied to the bottom flow path 54. A part of the hydraulic oil ejected from the second hydraulic pump 32 passes through the second boom operation valve 41R and then is supplied to the bottom flow path 54. The hydraulic oil ejected from the first hydraulic pump 31 and the hydraulic oil ejected from the second hydraulic pump 32 merge in the bottom flow path 54, and are then supplied to the bottom chamber 21A of the boom cylinder 21.

A part of the hydraulic oil ejected from the first hydraulic pump 31 passes through the first arm operation valve 42L and then is supplied to the bottom flow path 55. A part of the hydraulic oil ejected from the second hydraulic pump 32 passes through the second arm operation valve 42R and then is supplied to the bottom flow path 55. The hydraulic oil ejected from the first hydraulic pump 31 and the hydraulic oil ejected from the second hydraulic pump 32 merge in the bottom flow path 55, and are then supplied to the bottom chamber 22A of the arm cylinder 22.

A part of the hydraulic oil ejected from the first hydraulic pump 31 passes through the first bucket operation valve 43L and then is supplied to the bottom flow path 56. A part of the hydraulic oil ejected from the second hydraulic pump 32 passes through the second bucket operation valve 43R and then is supplied to the bottom flow path 56. The hydraulic oil ejected from the first hydraulic pump 31 and the hydraulic oil ejected from the second hydraulic pump 32 merge in the bottom flow path 56, and are then supplied to the bottom chamber 23A of the bucket cylinder 23.

When it is determined that the work state of the working equipment 10 is the normal state, the valve control unit 93 may control the first bucket operation valve 43L and the second bucket operation valve 43R such that hydraulic oil is supplied from one of the first hydraulic pump 31 and the second hydraulic pump 32 to the bottom chamber 23A of the bucket cylinder 23.

Figure 7:
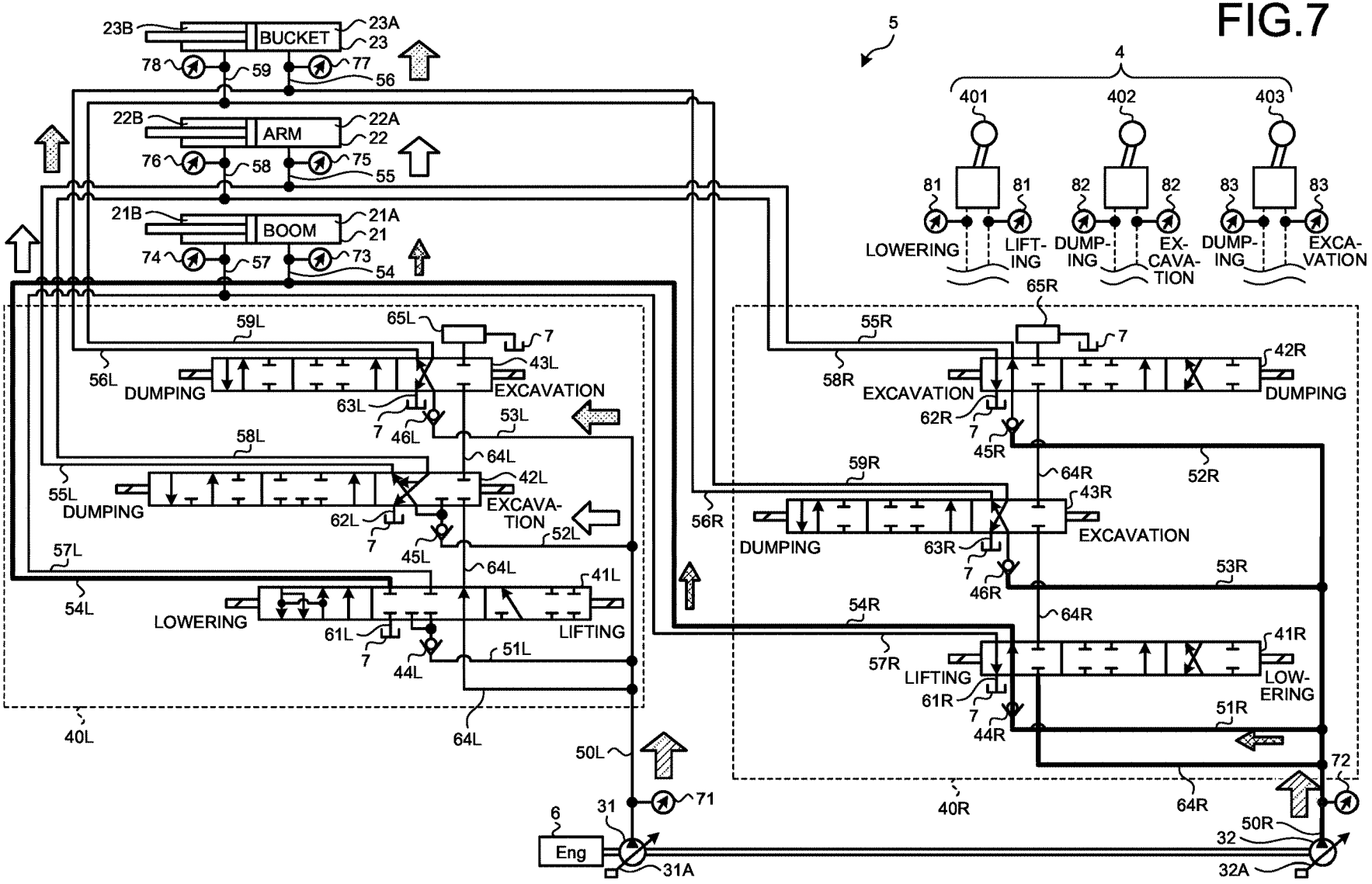
FIG. 7 is a schematic diagram illustrating a hydraulic system when it is determined that a work state of the working equipment according to the embodiment is a heavy excavation state.

FIG. 7 is a schematic diagram illustrating the hydraulic system 5 when it is determined that the work state of the working equipment 10 according to the embodiment is the heavy excavation state. FIG. 7 illustrates a state in which the hydraulic system 5 is set to the second hydraulic oil supply state.

When it is determined that the work state of the working equipment 10 has changed from the normal state illustrated in FIG. 6 to the heavy excavation state, the valve control unit 93 performs valve control such that the hydraulic system 5 is changed from the first hydraulic oil supply state to the second hydraulic oil supply state.

As illustrated in FIG. 7, when it is determined that the work state of the working equipment 10 has changed from the normal state to the heavy excavation state, the valve control unit 93 controls the first boom operation valve 41L so that passing of hydraulic oil from the first hydraulic pump 31 to the boom cylinder 21 is restricted.

When it is determined that the work state of the working equipment 10 is the heavy excavation state, the valve control unit 93 controls the first boom operation valve 41L, the first arm operation valve 42L, the first bucket operation valve 43L, the second boom operation valve 41R, the second arm operation valve 42R, and the second bucket operation valve 43R such that passing of hydraulic oil from the first hydraulic pump 31 to the boom cylinder 21 is restricted, hydraulic oil is supplied from the second hydraulic pump 32 to the boom cylinder 21, hydraulic oil is supplied from both the first hydraulic pump 31 and the second hydraulic pump 32 to the arm cylinder 22, and hydraulic oil is supplied from one or both of the first hydraulic pump 31 and the second hydraulic pump 32 to the bucket cylinder 23.

In the example illustrated in FIG. 7, the spool of the first boom operation valve 41L is disposed at the neutral position. That is, when it is determined that a change has been made from the normal state to the heavy excavation state, the valve control unit 93 moves the spool of the first boom operation valve 41L from the bottom chamber supply position to the neutral position so that passing of hydraulic oil from the first hydraulic pump 31 to the boom cylinder 21 is restricted.

In the heavy excavation state, the spool of the first boom operation valve 41L is disposed at the neutral position. Thus, the first boom operation valve 41L blocks passing of the hydraulic oil. The hydraulic oil ejected from the first hydraulic pump 31 is not supplied to the boom cylinder 21.

In the heavy excavation state, each of the spool of the first arm operation valve 42L and the spool of the first bucket operation valve 43L is disposed at the bottom chamber supply position. Thus, a part of the hydraulic oil ejected from the first hydraulic pump 31 passes through the first arm operation valve 42L and then is supplied to the bottom chamber 22A of the arm cylinder 22. A part of the hydraulic oil ejected from the first hydraulic pump 31 passes through the first bucket operation valve 43L and then is supplied to the bottom chamber 23A of the bucket cylinder 23.

In the heavy excavation state, the spool of the second boom operation valve 41R is disposed at the bottom chamber supply position. Thus, the hydraulic oil ejected from the second hydraulic pump 32 passes through the second boom operation valve 41R and then is supplied to the bottom chamber 21A of the boom cylinder 21.

In the heavy excavation state, each of the spool of the second arm operation valve 42R and the spool of the second bucket operation valve 43R is disposed at the bottom chamber supply position. In the embodiment, the arm check valve 45R is disposed in the supply flow path 52R. In the example illustrated in FIG. 7, at least a part of the hydraulic oil ejected from the first hydraulic pump 31 is supplied to the bottom flow path 55R and the second arm operation valve 42R. The absorption torque of the first hydraulic pump 31 is higher than the absorption torque of the second hydraulic pump 32. The pressure in the bottom flow path 55R between the arm cylinder 22 and the arm check valve 45R is higher than the pressure in the supply flow path 52R between the second hydraulic pump 32 and the arm check valve 45R. The hydraulic oil ejected from the second hydraulic pump 32 cannot pass through the arm check valve 45R. The arm check valve 45R blocks passing of the hydraulic oil ejected from the second hydraulic pump 32. Thus, the hydraulic oil is not supplied from the second hydraulic pump 32 to the arm cylinder 22. The bucket check valve 46R is disposed in the supply flow path 53R. Similarly to the arm check valve 45R, the bucket check valve 46R blocks passing of the hydraulic oil ejected from the second hydraulic pump 32. Thus, the hydraulic oil is not supplied from the second hydraulic pump 32 to the bucket cylinder 23.

In this manner, in the normal state, the hydraulic oil ejected from the first hydraulic pump 31 is distributed to each of the bottom chamber 21A of the boom cylinder 21, the bottom chamber 22A of the arm cylinder 22, and the bottom chamber 23A of the bucket cylinder 23. In the normal state, the hydraulic oil ejected from the second hydraulic pump 32 is distributed to each of the bottom chamber 21A of the boom cylinder 21, the bottom chamber 22A of the arm cylinder 22, and the bottom chamber 23A of the bucket cylinder 23.

In the heavy excavation state, the hydraulic oil ejected from the first hydraulic pump 31 is supplied to the bottom chamber 22A of the arm cylinder 22 and the bottom chamber 23A of the bucket cylinder 23 but is not supplied to the boom cylinder 21. The hydraulic oil ejected from the second hydraulic pump 32 is supplied to the bottom chamber 21A of the boom cylinder 21 but is not supplied to the arm cylinder 22 or the bucket cylinder 23.

As illustrated in FIG. 6, in the normal state, each spool of the first boom operation valve 41L, the second boom operation valve 41R, the first arm operation valve 42L, the second arm operation valve 42R, the first bucket operation valve 43L, and the second bucket operation valve 43R is disposed at the bottom chamber supply position. When it is determined that a change has been made from the normal state to the heavy excavation state, the valve control unit 93 moves only the spool of the first boom operation valve 41L from the bottom chamber supply position to the neutral position so that passing of hydraulic oil from the first hydraulic pump 31 to the boom cylinder 21 is restricted.

In the heavy excavation state, the first boom operation valve 41L does not have to block passing of hydraulic oil from the first hydraulic pump 31 to the boom cylinder 21. In the heavy excavation state, the first boom operation valve 41L may supply hydraulic oil to the boom cylinder 21 at a flow rate smaller than the flow rate of hydraulic oil to be supplied from the first hydraulic pump 31 to the boom cylinder 21 in the normal state. For example, when it is determined that a change has been made to the heavy excavation state from the normal state in which each spool of the first boom operation valve 41L, the second boom operation valve 41R, the first arm operation valve 42L, the second arm operation valve 42R, the first bucket operation valve 43L, and the second bucket operation valve 43R is disposed at the bottom chamber supply position, the valve control unit 93 may move only the spool of the first boom operation valve 41L such that the flow rate of hydraulic oil to be supplied from the first hydraulic pump 31 to the boom cylinder 21 decreases.

The arm check valve 45R and the bucket check valve 46R may be omitted. When it is determined that the work state of the working equipment 10 is the heavy excavation state, the valve control unit 93 may move the spool of the first boom operation valve 41L to the neutral position and dispose the spool of the second boom operation valve 41R into the bottom chamber supply position so that hydraulic oil is supplied from the second hydraulic pump 32 to the boom cylinder 21 and hydraulic is not supplied from the first hydraulic pump 31 to the boom cylinder 21. When it is determined that the work state of the working equipment 10 is the heavy excavation state, the valve control unit 93 may dispose the spool of the first arm operation valve 42L into the bottom chamber supply position and move the spool of the second arm operation valve 42R to the neutral position so that hydraulic oil is supplied from the first hydraulic pump 31 to the arm cylinder 22 and hydraulic oil is not supplied from the second hydraulic pump 32 to the arm cylinder 22. When it is determined that the work state of the working equipment 10 is the heavy excavation state, the valve control unit 93 may dispose the spool of the first bucket operation valve 43L into the bottom chamber supply position and dispose the spool of the second bucket operation valve 43R into the neutral position so that hydraulic oil is supplied from the first hydraulic pump 31 to the bucket cylinder 23 and hydraulic oil is not supplied from the second hydraulic pump 32 to the bucket cylinder 23.

[Method for Controlling Excavator]

Figure 8:
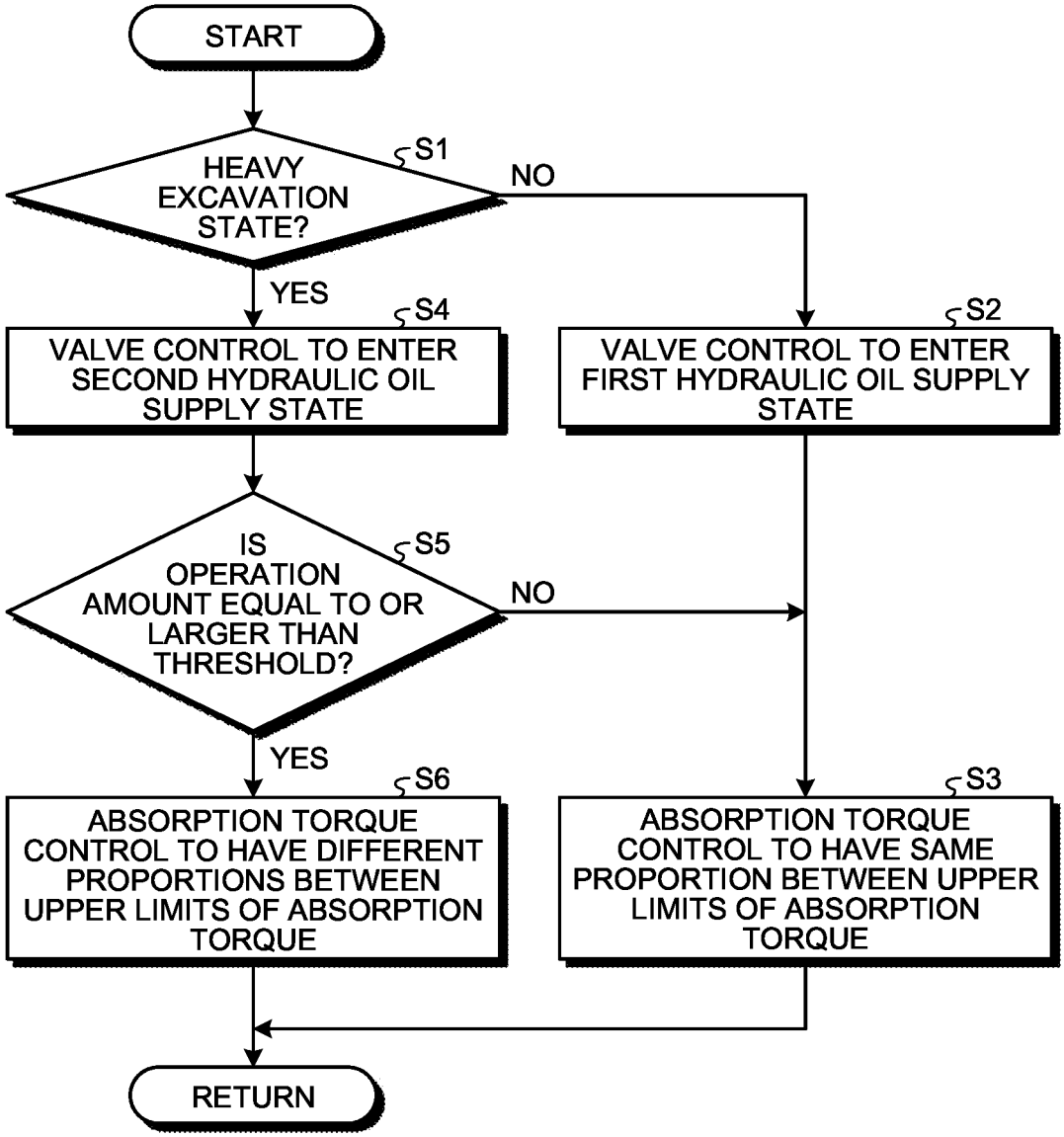
FIG. 8 is a flowchart illustrating a method for controlling an excavator according to the embodiment.

FIG. 8 is a flowchart illustrating a method for controlling the excavator 1 according to the embodiment. Operation of the excavator 1 is started. The work state determination unit 92 determines whether the work state of the working equipment 10 has changed from the normal state to the heavy excavation state (Step S1).

That is, as described with reference to FIG. 5, the work state determination unit 92 determines whether the arm excavation amount is equal to or larger than the first threshold R1 or the bucket excavation operation amount is equal to or larger than the second threshold R2, and whether the higher value of the arm bottom pressure and the bucket bottom pressure is higher than the boom bottom pressure.

In Step S1, when it is determined that the work state of the working equipment 10 has not changed from the normal state to the heavy excavation state (Step S1: No), the pump control unit 94 performs valve control such that the hydraulic system 5 enters the first hydraulic oil supply state described with reference to FIG. 6 (Step S2).

The pump control unit 94 performs absorption torque control such that the upper limit of the absorption torque Tp1 of the first hydraulic pump 31 and the upper limit of the absorption torque Tp2 of the second hydraulic pump 32 have the same proportion (Step S3).

In Step S1, when it is determined that the work state of the working equipment 10 has changed from the normal state to the heavy excavation state (Step S1: Yes), the pump control unit 94 performs valve control such that the hydraulic system 5 enters the second hydraulic oil supply state described with reference to FIG. 7 (Step S4).

The work state determination unit 92 determines whether the boom lifting operation amount is equal to or larger than the third threshold R3, the arm excavation operation amount is equal to or larger than the fourth threshold R4, and the bucket excavation operation amount is equal to or larger than the fifth threshold R5 in the heavy excavation state (Step S5).

In Step S5, when it is determined that the boom lifting operation amount is equal to or larger than the third threshold R3, the arm excavation operation amount is equal to or larger than the fourth threshold R4, and the bucket excavation operation amount is not equal to or larger than the fifth threshold R5 in the heavy excavation state (Step S5: No), the pump control unit 94 performs absorption torque control such that the upper limit of the absorption torque Tp1 of the first hydraulic pump 31 and the upper limit of the absorption torque Tp2 of the second hydraulic pump 32 have the same proportion (Step S3).

In Step S5, when it is determined that the boom lifting operation amount is equal to or larger than the third threshold R3, the arm excavation operation amount is equal to or larger than the fourth threshold R4, and the bucket excavation operation amount is equal to or larger than the fifth threshold R5 in the heavy excavation state (Step S5: Yes), the pump control unit 94 performs absorption torque control such that the upper limit of the absorption torque Tp1 of the first hydraulic pump 31 and the upper limit of the absorption torque Tp2 of the second hydraulic pump 32 have different proportions. The pump control unit 94 performs absorption torque control such that the upper limit of the absorption torque Tp1 of the first hydraulic pump 31 becomes higher than the upper limit of the absorption torque Tp2 of the second hydraulic pump 32 (Step S6).

Figure 9:
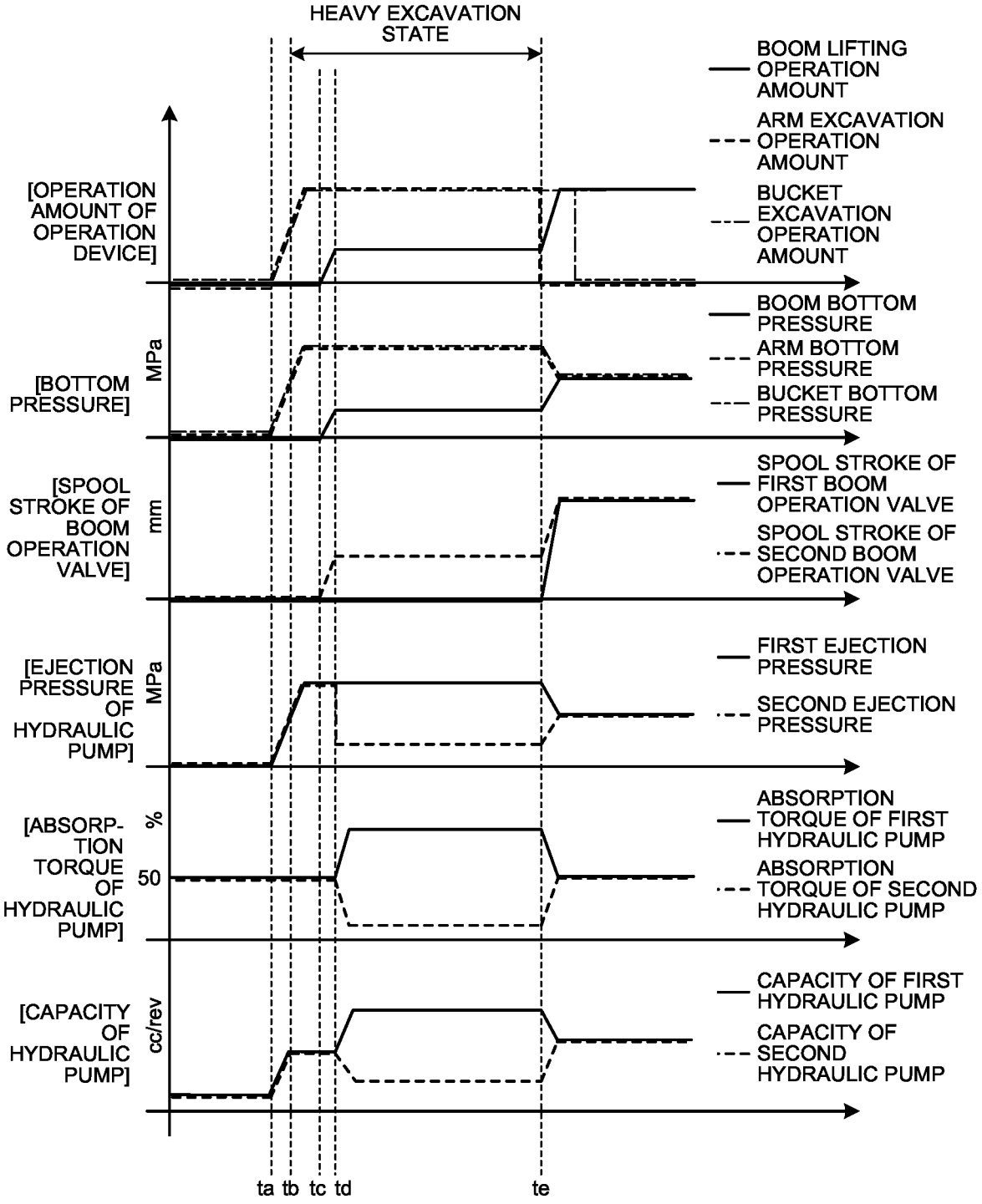
FIG. 9 is a time chart illustrating a method for controlling an excavator according to the embodiment.

FIG. 9 is a time chart illustrating a method for controlling the excavator 1 according to the embodiment. At a time point ta, the operation device 4 is caused to perform the arm excavation operation and the bucket excavation operation. At a time point tb after the time point ta, when the arm excavation operation amount is equal to or larger than the first threshold R1, the bucket excavation operation amount is equal to or larger than the second threshold R2, and the higher value of the arm bottom pressure and the bucket bottom pressure is higher than the boom bottom pressure, it is determined that the heavy excavation state is established. In the heavy excavation state, each of the arm bottom pressure and the bucket bottom pressure becomes high. On the other hand, the boom bottom pressure is low.

When it is determined that the work state of the working equipment 10 is the heavy excavation state, the valve control unit 93 moves the spool of the first boom operation valve 41L from the bottom chamber supply position illustrated in FIG. 6 to the neutral position illustrated in FIG. 7 at a time point tc after the time point tb. The movement of the spool of the first boom operation valve 41L may be started at the time point tb or may be started at a time point between the time point tb and the time point tc.

The hydraulic oil ejected from the first hydraulic pump 31 is supplied to each of the bottom chamber 22A of the arm cylinder 22 and the bottom chamber 23A of the bucket cylinder 23. The hydraulic oil ejected from the second hydraulic pump 32 is supplied to the bottom chamber 21A of the boom cylinder 21.

In the heavy excavation state in which the excavation load applied to the working equipment 10 is high, the operator performs the boom lifting operation so that the excavation load applied to the bucket 13 and the arm 12 decreases. In the example illustrated in FIG. 9, the boom lifting operation is started at the time point tc. When the boom lifting operation is performed, the boom bottom pressure increases.

When the boom lifting operation is started, the pump control unit 94 starts absorption torque control for changing the proportion between the upper limit of the absorption torque Tp1 of the first hydraulic pump 31 and the upper limit of the absorption torque Tp2 of the second hydraulic pump 32 so that the upper limit of the absorption torque Tp1 of the first hydraulic pump 31 becomes higher than the upper limit of the absorption torque Tp2 of the second hydraulic pump 32 at a time point td after the time point tc. Since the upper limit of the absorption torque Tp1 of the first hydraulic pump 31 increases, hydraulic oil is smoothly supplied from the first hydraulic pump 31 to each of the arm cylinder 22 and the bucket cylinder 23.

When the arm excavation operation is ended at a time to after the time td, the work state determination unit 92 determines that the work state of the working equipment 10 becomes the normal state.

[Computer System]

Figure 10:
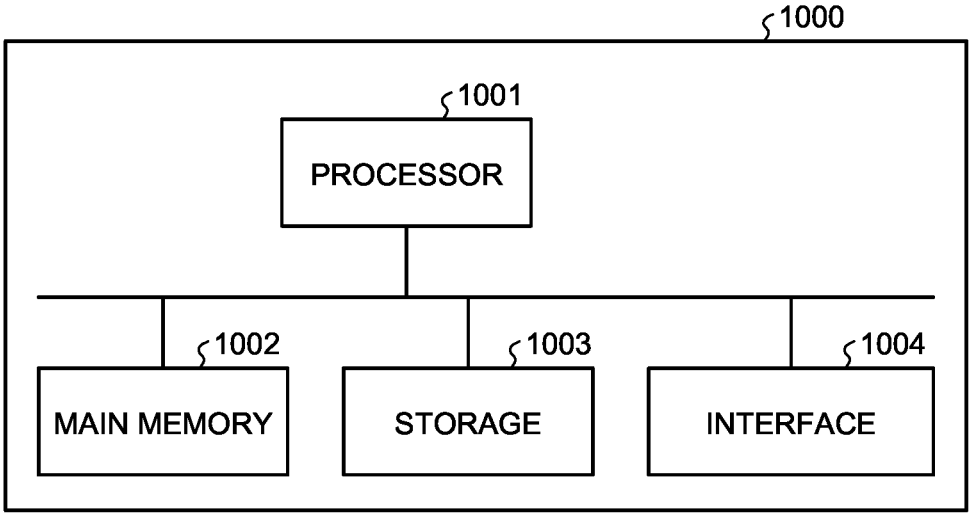
FIG. 10 is a block diagram illustrating a computer system according to the embodiment.

FIG. 10 is a block diagram illustrating a computer system 1000 according to the embodiment. The above-described control device 9 includes the computer system 1000. The computer system 1000 includes a processor 1001 such as a central processing unit (CPU), a main memory 1002 including a nonvolatile memory such as a read only memory (ROM) and a volatile memory such as a random access memory (RAM), a storage 1003, and an interface 1004 including an input/output circuit. The function of the control device 9 is stored in the storage 1003 as a computer program. The processor 1001 reads out the computer program from the storage 1003, develops the computer program in the main memory 1002, and executes the above-described processing according to the computer program. The computer program may be delivered to the computer system 1000 via a network.

[Effects]

As described above, according to the embodiment, when it is determined that the work state of the working equipment 10 is the normal state, hydraulic oil is supplied from both the first hydraulic pump 31 and the second hydraulic pump 32 to the bottom chamber 21A of the boom cylinder 21, hydraulic oil is supplied from both the first hydraulic pump 31 and the second hydraulic pump 32 to the bottom chamber 22A of the arm cylinder 22, and hydraulic oil is supplied from one or both of the first hydraulic pump 31 and the second hydraulic pump 32 to the bottom chamber 23A of the bucket cylinder 23. When the work state of the working equipment 10 is the normal state, this causes the hydraulic oil ejected from the first hydraulic pump 31 and the second hydraulic pump 32 to be appropriately distributed to each of the bottom chamber 21A of the boom cylinder 21, the bottom chamber 22A of the arm cylinder 22, and the bottom chamber 23A of the bucket cylinder 23.

When it is determined that the work state of the working equipment 10 is the heavy excavation state, hydraulic oil is supplied from the second hydraulic pump 32 to the bottom chamber 21A of the boom cylinder 21, and the supply of hydraulic oil from the first hydraulic pump 31 to the boom cylinder 21 is blocked. When it is determined that the work state of the working equipment 10 is the heavy excavation state, the hydraulic oil is supplied from the first hydraulic pump 31 to the bottom chamber 22A of the arm cylinder 22 and the bottom chamber 23A of the bucket cylinder 23, and the supply of hydraulic oil from the second hydraulic pump 32 to the arm cylinder 22 and the bucket cylinder 23 is blocked.

In the heavy excavation state, each of the arm cylinder 22 and the bucket cylinder 23 attempts to retract with the action of the excavation reaction force. Thus, each of the arm bottom pressure and the bucket bottom pressure becomes high. On the other hand, the weight of the working equipment 10 applied to the boom cylinder 21 is reduced by the excavation reaction force. Thus, the boom bottom pressure becomes lower than the arm bottom pressure and the bucket bottom pressure. When the supply of hydraulic oil from the first hydraulic pump 31 to the bottom chamber 21A of the boom cylinder 21 is not blocked in the heavy excavation state, the hydraulic oil ejected from the first hydraulic pump 31 is supplied to the boom cylinder 21, and the pressure of hydraulic oil to be supplied to the bottom chamber 22A of the arm cylinder 22 and the pressure of hydraulic oil to be supplied to the bottom chamber 23A of the bucket cylinder 23 are likely to become insufficient. As a result, there is a possibility that the excavation power of the working equipment 10 decreases.

In the embodiment, in the heavy excavation state, the supply of hydraulic oil from the first hydraulic pump 31 to the bottom chamber 21A of the boom cylinder 21 is blocked. Thus, insufficiency of the pressure of hydraulic oil to be supplied to the bottom chamber 22A of the arm cylinder 22 and the pressure of the hydraulic oil supplied to the bottom chamber 23A of the bucket cylinder 23 is prevented. The boom cylinder 21 can be actuated with the hydraulic oil supplied from the second hydraulic pump 32. In this manner, even when the work state of the working equipment 10 is the heavy excavation state, the hydraulic oil ejected from the first hydraulic pump 31 and the second hydraulic pump 32 is appropriately distributed to each of the bottom chamber 21A of the boom cylinder 21, the bottom chamber 22A of the arm cylinder 22, and the bottom chamber 23A of the bucket cylinder 23.

In the heavy excavation state in which the excavation load applied to the working equipment 10 is high, the operator often performs the boom lifting operation so that the excavation load applied to the bucket 13 and the arm 12 decreases. When determining that the boom lifting operation is performed with the work state of the working equipment 10 being the heavy excavation state, the pump control unit 94 makes the absorption torque of the first hydraulic pump 31 higher than the absorption torque of the second hydraulic pump 32. In the heavy excavation state, the first hydraulic pump 31 supplies hydraulic oil to the two hydraulic cylinders of the arm cylinder 22 and the bucket cylinder 23, and the second hydraulic pump 32 supplies hydraulic oil to the boom cylinder 21. Thus, the absorption torque of the first hydraulic pump 31 in the heavy excavation state is increased, which prevents the shortage of hydraulic oil to be supplied to the arm cylinder 22 and the bucket cylinder 23.

REFERENCE SIGNS LIST

1 EXCAVATOR
2 SWING BODY
2A OPERATION ROOM
2B OPERATOR'S SEAT
3 TRAVEL BODY
3A CRAWLER BELT
4 OPERATION DEVICE
5 HYDRAULIC SYSTEM
6 ENGINE
7 TANK
9 CONTROL DEVICE
10 WORKING EQUIPMENT
11 BOOM
12 ARM
13 BUCKET
21 BOOM CYLINDER
21A BOTTOM CHAMBER
21B ROD CHAMBER
22 ARM CYLINDER
22A BOTTOM CHAMBER
22B ROD CHAMBER
23 BUCKET CYLINDER
23A BOTTOM CHAMBER
23B ROD CHAMBER
31 FIRST HYDRAULIC PUMP
31A SWASH PLATE
32 SECOND HYDRAULIC PUMP
32A SWASH PLATE
40L FIRST OPERATION VALVE GROUP
40R SECOND OPERATION VALVE GROUP
41L FIRST BOOM OPERATION VALVE
41R SECOND BOOM OPERATION VALVE
42L FIRST ARM OPERATION VALVE
42R SECOND ARM OPERATION VALVE
43L FIRST BUCKET OPERATION VALVE
43R SECOND BUCKET OPERATION VALVE
44L BOOM CHECK VALVE
44R BOOM CHECK VALVE
45L ARM CHECK VALVE
45R ARM CHECK VALVE
46L BUCKET CHECK VALVE
46R BUCKET CHECK VALVE
50L EJECTION FLOW PATH
50R EJECTION FLOW PATH
51L SUPPLY FLOW PATH
51R SUPPLY FLOW PATH
52L SUPPLY FLOW PATH
52R SUPPLY FLOW PATH
53L SUPPLY FLOW PATH
53R SUPPLY FLOW PATH
54 BOTTOM FLOW PATH
54L BOTTOM FLOW PATH
54R BOTTOM FLOW PATH
55 BOTTOM FLOW PATH
55L BOTTOM FLOW PATH
55R BOTTOM FLOW PATH
56 BOTTOM FLOW PATH
56L BOTTOM FLOW PATH
56R BOTTOM FLOW PATH
57 ROD FLOW PATH
57L ROD FLOW PATH
57R ROD FLOW PATH
58 ROD FLOW PATH
58L ROD FLOW PATH
58R ROD FLOW PATH
59 ROD FLOW PATH
59L ROD FLOW PATH
59R ROD FLOW PATH
61L DISCHARGE FLOW PATH
61R DISCHARGE FLOW PATH
62L DISCHARGE FLOW PATH
62R DISCHARGE FLOW PATH
63L DISCHARGE FLOW PATH
63R DISCHARGE FLOW PATH
64L NEUTRAL FLOW PATH
64R NEUTRAL FLOW PATH
65L NEGATIVE CONTROL MECHANISM
65R NEGATIVE CONTROL MECHANISM
71 FIRST EJECTION PRESSURE SENSOR
72 SECOND EJECTION PRESSURE SENSOR
73 BOOM BOTTOM PRESSURE SENSOR

74 BOOM ROD PRESSURE SENSOR
75 ARM BOTTOM PRESSURE SENSOR
76 ARM ROD PRESSURE SENSOR
77 BUCKET BOTTOM PRESSURE SENSOR
78 BUCKET ROD PRESSURE SENSOR
81 BOOM OPERATION AMOUNT SENSOR
82 ARM OPERATION AMOUNT SENSOR
83 BUCKET OPERATION AMOUNT SENSOR
91 DETECTION DATA ACQUISITION UNIT
92 WORK STATE DETERMINATION UNIT
93 VALVE CONTROL UNIT
94 PUMP CONTROL UNIT
95 STORAGE UNIT
401 BOOM WORK LEVER
402 ARM WORK LEVER
403 BUCKET WORK LEVER

The invention claimed is:

1. A hydraulic system of an excavator, the hydraulic system comprising:

a first hydraulic pump;

a second hydraulic pump;

a boom cylinder that moves a boom of working equipment;

an arm cylinder that moves an arm of the working equipment;

a bucket cylinder that moves a bucket of the working equipment;

a first boom operation valve that controls passing of hydraulic oil from the first hydraulic pump to the boom cylinder;

a first arm operation valve that controls passing of hydraulic oil from the first hydraulic pump to the arm cylinder;

a first bucket operation valve that controls passing of hydraulic oil from the first hydraulic pump to the bucket cylinder;

a second boom operation valve that controls passing of hydraulic oil from the second hydraulic pump to the boom cylinder;

a second arm operation valve that controls passing of hydraulic oil from the second hydraulic pump to the arm cylinder;

a second bucket operation valve that controls passing of hydraulic oil from the second hydraulic pump to the bucket cylinder;

an arm check valve that prevents backflow of hydraulic oil from the arm cylinder to the second hydraulic pump via the second arm operation valve;

a bucket check valve that prevents backflow of hydraulic oil from the bucket cylinder to the second hydraulic pump via the second bucket operation valve;

an operation device operated to actuate at least one of the boom cylinder, the arm cylinder, and the bucket cylinder;

a work state determination unit that determines a work state of the working equipment based on an operation state of the operation device, a boom bottom pressure indicating a pressure of a bottom chamber of the boom cylinder, an arm bottom pressure indicating a pressure of a bottom chamber of the arm cylinder, and a bucket bottom pressure indicating a pressure of a bottom chamber of the bucket cylinder; and a valve control unit that controls at least one of the first boom operation valve, the first arm operation valve, the first bucket operation valve, the second boom operation valve, the second arm operation valve, and the second bucket operation valve based on the work state of the working equipment determined by the work state determination unit, wherein the work state determination unit determines that the work state of the working equipment is a normal state when an arm excavation operation amount of the operation device is equal to or larger than a first threshold, or a bucket excavation operation amount of the operation device is equal to or larger than a second threshold, and the boom bottom pressure is higher than a higher value of the arm bottom pressure and the bucket bottom pressure, and determines that the work state of the working equipment is a heavy excavation state when a higher value of the arm bottom pressure and the bucket bottom pressure is higher than the boom bottom pressure, and when it is determined that the work state of the working equipment is the heavy excavation state, the valve control unit controls the first boom operation valve, the first arm operation valve, the first bucket operation valve, the second boom operation valve, the second arm operation valve, and the second bucket operation valve such that passing of hydraulic oil from the first hydraulic pump to the boom cylinder is restricted, hydraulic oil is supplied from the second hydraulic pump to the boom cylinder, hydraulic oil is supplied from both the first hydraulic pump and the second hydraulic pump to the arm cylinder, and hydraulic oil is supplied from one or both of the first hydraulic pump and the second hydraulic pump to the bucket cylinder.

2. The hydraulic system of an excavator according to claim 1, wherein when it is determined that the work state of the working equipment is the normal state, the valve control unit controls the first boom operation valve, the first arm operation valve, the first bucket operation valve, the second boom operation valve, the second arm operation valve, and the second bucket operation valve such that hydraulic oil is supplied from both the first hydraulic pump and the second hydraulic pump to the boom cylinder, hydraulic oil is supplied from both the first hydraulic pump and the second hydraulic pump to the arm cylinder, and hydraulic oil is supplied from one or both of the first hydraulic pump and the second hydraulic pump to the bucket cylinder.

3. The hydraulic system of an excavator according to claim 2, wherein in the normal state, a spool of each of the first boom operation valve, the second boom operation valve, the first arm operation valve, the second arm operation valve, the first bucket operation valve, and the second bucket operation valve is disposed at a bottom chamber supply position, and when it is determined that a change has been made from the normal state to the heavy excavation state, the valve control unit moves only the spool of the first boom operation valve in such a manner that passing of hydraulic oil from the first hydraulic pump to the boom cylinder is restricted.

4. The hydraulic system of an excavator according to claim 1, the hydraulic system comprising:

an arm operation amount sensor that detects an arm operation amount of the operation device;

a bucket operation amount sensor that detects a bucket operation amount of the operation device;

an arm bottom pressure sensor that detects the arm bottom pressure; and a bucket bottom pressure sensor that detects the bucket bottom pressure, wherein the work state determination unit determines the work state based on detection data of the arm operation amount sensor, detection data of the bucket operation amount sensor, detection data of the arm bottom pressure sensor, and detection data of the bucket bottom pressure sensor.

5. The hydraulic system of an excavator according to claim 1, the hydraulic system comprising a pump control unit that makes an upper limit of an absorption torque of the first hydraulic pump higher than an upper limit of an absorption torque of the second hydraulic pump when it is determined that a boom lifting operation amount is equal to or larger than a third threshold in the heavy excavation state.

6. The hydraulic system of an excavator according to claim 5, the hydraulic system comprising a boom operation amount sensor that detects a boom operation amount of the operation device, wherein the work state determination unit determines whether the boom lifting operation amount is equal to or larger than the third threshold based on detection data of the boom operation amount sensor.

7. The hydraulic system of an excavator according to claim 5, wherein when it is determined that the arm excavation operation amount is equal to or larger than a fourth threshold and the bucket excavation operation amount is equal to or larger than a fifth threshold in the heavy excavation state, the pump control unit makes the upper limit of the absorption torque of the first hydraulic pump higher than the upper limit value of the absorption torque of the second hydraulic pump.

8. An excavator comprising the hydraulic system of an excavator according to claim 1.

9. A method for controlling an excavator, the excavator comprising:

a first hydraulic pump;

a second hydraulic pump;

a boom cylinder that moves a boom of working equipment;

an arm cylinder that moves an arm of the working equipment;

a bucket cylinder that moves a bucket of the working equipment;

a first boom operation valve that controls passing of hydraulic oil from the first hydraulic pump to the boom cylinder;

a first arm operation valve that controls passing of hydraulic oil from the first hydraulic pump to the arm cylinder;

a first bucket operation valve that controls passing of hydraulic oil from the first hydraulic pump to the bucket cylinder;

a second boom operation valve that controls passing of hydraulic oil from the second hydraulic pump to the boom cylinder;

a second arm operation valve that controls passing of hydraulic oil from the second hydraulic pump to the arm cylinder;

a second bucket operation valve that controls passing of hydraulic oil from the second hydraulic pump to the bucket cylinder;

an arm check valve that prevents backflow of hydraulic oil from the arm cylinder to the second hydraulic pump via the second arm operation valve;

a bucket check valve that prevents backflow of hydraulic oil from the bucket cylinder to the second hydraulic pump via the second bucket operation valve; and an operation device operated to actuate at least one of the boom cylinder, the arm cylinder, and the bucket cylinder, the method comprising:

determining a work state of the working equipment based on an operation state of the operation device, a boom bottom pressure indicating a pressure of a bottom chamber of the boom cylinder, an arm bottom pressure indicating a pressure of a bottom chamber of the arm cylinder, and a bucket bottom pressure indicating a pressure of a bottom chamber of the bucket cylinder;

determining that the work state of the working equipment is a normal state when an arm excavation operation amount of the operation device is equal to or larger than a first threshold, or a bucket excavation operation amount of the operation device is equal to or larger than a second threshold, and the boom bottom pressure is higher than a higher value of the arm bottom pressure and the bucket bottom pressure, and determining that the work state of the working equipment is a heavy excavation state when a higher value of the arm bottom pressure and the bucket bottom pressure is higher than the boom bottom pressure; and when it is determined that the work state of the working equipment is the heavy excavation state, controlling the first boom operation valve, the first arm operation valve, the first bucket operation valve, the second boom operation valve, the second arm operation valve, and the second bucket operation valve such that passing of hydraulic oil from the first hydraulic pump to the boom cylinder is restricted, hydraulic oil is supplied from the second hydraulic pump to the boom cylinder, hydraulic oil is supplied from both the first hydraulic pump and the second hydraulic pump to the arm cylinder, and hydraulic oil is supplied from one or both of the first hydraulic pump and the second hydraulic pump to the bucket cylinder.

* * * * *